United States Patent [19]

Ingle

[11] 4,288,125

[45] Sep. 8, 1981

[54] MINING APPARATUS HAVING AN IMPROVED COUPLING ASSEMBLY

[75] Inventor: James E. Ingle, Edmond, Okla.

[73] Assignee: Kerr-McGee Corporation, Oklahoma City, Okla.

[21] Appl. No.: 32,465

[22] Filed: Apr. 23, 1979

Related U.S. Application Data

[63] Continuation-in-part of Ser. No. 768,650, Feb. 14, 1977, Pat. No. 4,160,566.

[51] Int. Cl.[3] ..... E21C 27/02

[52] U.S. Cl. ..... 299/30; 403/353

[58] Field of Search ..... 299/1, 30, 18; 403/353, 403/381, 360

[56] References Cited

U.S. PATENT DOCUMENTS

| | | | |
|---|---|---|---|
| 596,490 | 1/1898 | Edwards | 403/353 |
| 3,002,466 | 10/1961 | Read | 403/353 |
| 4,014,574 | 3/1977 | Todd | 299/18 |
| 4,053,182 | 10/1977 | Nelson | 299/30 |
| 4,160,566 | 7/1979 | McGee et al. | 299/18 |

*Primary Examiner*—William F. Pate, III

*Attorney, Agent, or Firm*—William G. Addison

[57] ABSTRACT

A mining apparatus for excavating material from an earth formation having a miner which is removably connectable to a carrier by a coupling assembly, the mining apparatus including other carriers which are interconnected by the coupling assembly of the present invention. The coupling assembly includes a male connector and a female connector, the male connector being disposable in a portion of the female connector in an insert position and the male connector being movable from the insert position to a connected position for interconnecting the male and the female connectors.

61 Claims, 16 Drawing Figures

MINING APPARATUS HAVING AN IMPROVED COUPLING ASSEMBLY

CROSS-REFERENCE TO RELATED APPLICATIONS

The present application is a continuation-in-part of the co-pending application entitled "MINING MACHINE", U.S. Ser. No. 768,650, filed on Feb. 14, 1977, now U.S. Pat. No. 4,160,566, which is assigned to the assignee of the present invention.

BACKGROUND OF THE INVENTION

1. Field of the Invention

The present invention generally relates to mining apparatus for excavating material from an earth formation, and, more particularly, but not by way of limitation, to an improved coupling assembly for removably connecting a carrier to other carriers and to a miner.

BRIEF DESCRIPTION OF THE DRAWINGS

FIG. 3 is a side elevational view of a miner, showing the rearward cutter assembly in a material engaging position and depicting the female coupler of the coupling assembly carried by the miner for removably connecting the miner to a carrier.

DESCRIPTION OF THE PREFERRED EMBODIMENTS

Figure 1:
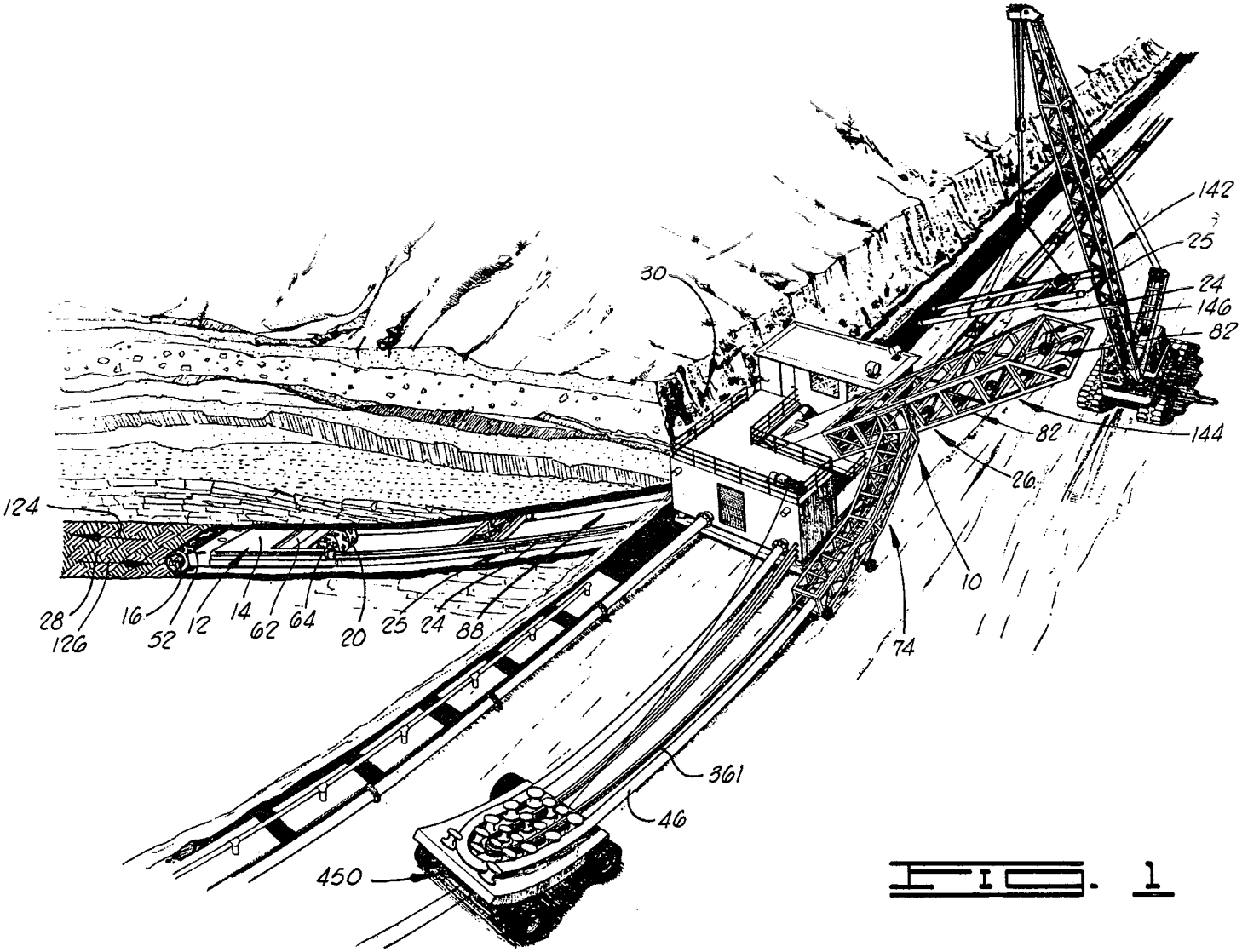
FIG. 1 is a diagrammatic view of a mining apparatus employing the improved coupling assembly of the present invention.
Figure 2:
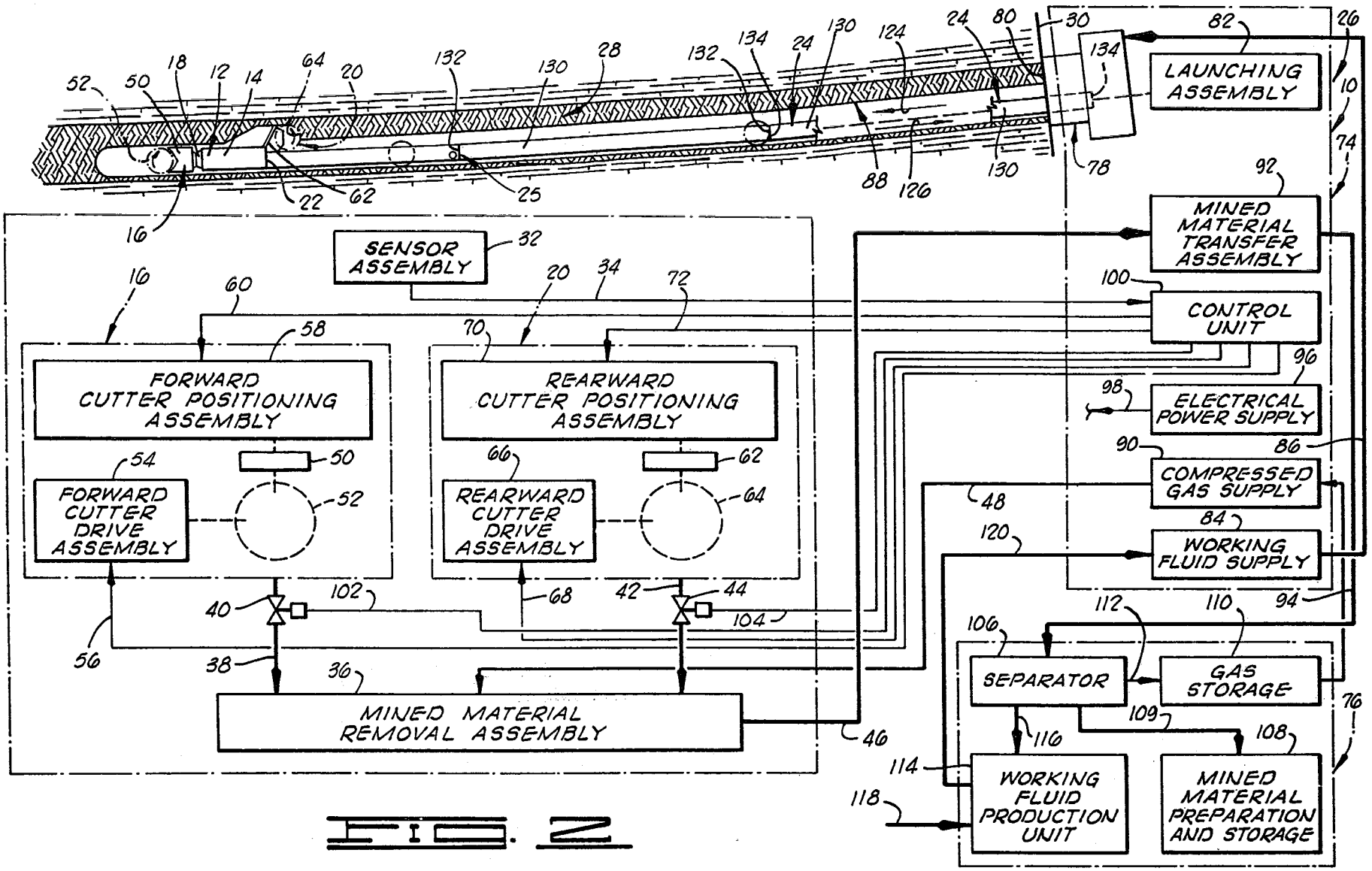
FIG. 2 is a diagrammatic, schematic view of the mining apparatus of FIG. 1.

Referring to the drawings in general and to FIGS. 1 and 2 in particular, diagrammatically and schematically shown therein and designated via the general reference numeral 10 is a mining apparatus utilizing the improved coupling assembly in accordance with the present invention. The construction and operation of a mining apparatus similar to the mining apparatus to is disclosed in detail in the co-pending application U.S. Ser. No. 768,650, filed Feb. 14, 1977, now U.S. Pat. No. 4,160,566, and entitled "MINING APPARATUS", which is incorporated herein by reference.

In general, the mining apparatus 10 includes: a miner 12, having a frame 14, a forward cutter assembly 16 which is movably connected to a forward end 18 of the frame 14, and a rearward cutter assembly 20 which is movably connected to a rearward end 22 of the frame 14; a plurality of carriers 24, each carrier 24 being connectable either to the rearward end 23 of the miner 12 or to another carrier by a coupling assemly 25, which will be described in detail below; and a surface assembly 26. The mining apparatus 10 is constructed and operated to excavatingly engage material in an earth formation and to remove the excavated material (sometimes referred to herein as the "mined material") from the earth formation. More particularly, the mining apparatus 10 is constructed and operated to excavatingly remove coal from a coal seam (diagrammatically shown in FIGS. 1 and 2 and designated therein via the general reference 28) which extends into the earth from a surface highwall 30 (sometimes referred to in the art as an "outcrop"), and the mining apparatus 10 is constructed such that all of the operations are remotely controlled from a remote location, such as the earth's surface or from a drift, for example, thereby eliminating the necessity and accompanying hazards and costs involved in utilizing personnel underground during the mining operations It should be noted that, although the coupling assembly 25 is described herein in conunction with the mining apparatus 10, the coupling assembly could be used in other applications or in conjunction with other apparatus. In addition, it should be noted that the terms "forward", "rearward", "upper", "lower" and other words describing the relative positions of various elements, assemblies and components of the present invention are utilized herein solely for the purpose of facilitating the description of the present invention and such terms are not to be construed to limit the present invention as defined in the claims.

The miner 12 includes: a sensor assembly 32 connected to miner 12 and constructed to sense and detect the coal seam 28 and to produce an output signal on a control line 34 indicating the detected position of the coal seam 28 (the sensor assembly 32, more particularly, may produce a plurality of output signals); and a mined material removal assembly 36, which is connected to the forward cutter assembly 16 via a conduit 38, having a valve 40 interposed therein and disposed generally between the forward cutter assembly 16 and the mined material removal assembly 36, and which is connected to the rearward cutter assembly 20 via a conduit 42, having a valve 44 interposed therein and disposed generally between the rearward cutter assembly 20 and the mined material removal assembly 36, the mined material removal assembly 36 receiving the mined material via either the conduit 38 or the conduit 42 and discharging the mined material through a conduit 46. The mined material removal assembly 36 receives compressed gas via a conduit 48 and is constructed to inject the received compressed gas into the slurry of the mined material prior to discharging the slurry of the mined material and the compressed gas through the conduit 46. The compressed gas reduces the weight of the mined material in the conduit 46 (a bouyancy effect) and acts to create a pressure differential between the mined material in the conduit 46 and the material outside the tube, thereby resulting in the flow of the mined material through the conduit 46, the compressed gas acting to facilitate the pumping of the slurry through the conduit 46 (the term "gas" as used herein in conjunction with the gas received by the mined material removal assembly 36 includes air). It should be noted that a slurry pump can be located at the surface for cooperating with the injected gas to effect the moving of the mined material to the surface, as will be described below in connection with the mind material transfer assembly.

The forward cutter assembly 16 includes: a forward cutter frame 50, which is movably connected to the forward end 18 of the frame 14; a forward cutter 52, which is mechanically connected to and rotatably mounted on the forward cutter frame 50, the forward cutter 52 being constructed and mounted on the forward cutter frame 50 for excavatingly engaging the material (coal) to be mined; a forward cutter drive assembly 54, which is mechanically connected to the forward cutter 52, the forward cutter drive assembly 54 rotatingly driving the forward cutter 52 in response to receiving a signal via a control line 56 (the signal received via the control line 56 may be hydraulic, pneumatic or electrical or a combination thereof); and a forward cutter positioning assembly 58, which is mechanically connected to the forward cutter frame 50 and which receives a signal via a control line 60 (the signal received via the control line 60 may be hydraulic, pneumatic or electrical or a combination thereof), the forward cutter positioning assembly 58 moving the forward cutter frame 50 and the forward cutter 52 in response to the signal received via the control line 60.

The rearward cutter assembly 20 includes: a rearward cutter frame 62, which is movably connected to the rearward end 22 of the frame 14; a rearward cutter 64, which is mechanically connected to and rotatably mounted on the rearward cutter frame 62, the rearward cutter 64 being constructed and mounted on the rearward cutter frame 62 for excavatingly engaging the material (coal) to be mined; a rearward cutter drive assembly 66, which is mechanically connected to the rearward cutter 64, the rearward cutter drive assembly 66 rotatingly driving the rearward cutter 64 in response to receiving a signal via a control line 68 (the signal received via the control line 68 may be hydraulic, pneumatic or electrical or a combination thereof); and a rearward cutter positioning assembly 70, which is mechanically connected to the rearward cutter frame 62 and which receives a signal via a control line 72 (the signal received via the control line 72 may be hydraulic, pneumatic or electrical or a combination thereof), the rearward cutter positioning assembly 70 moving the rearward cutter frame 62 and the rearward cutter 64 in response to the signal received via the control line 72.

The surface assembly 26 includes: a surface unit 74, which is constructed to launch and force or drive the miner 12 and carriers 24 into the coal seam 28 and to retrieve or withdraw the miner 12 and carriers 24 from the coal seam 28 and, in general, to control the movement of the miner 12 through the coal seam 28; and an auxiliary assembly 76. The surface unit 74 includes: a caisson 78 having one end 80 sealingly engagable with a portion of the highwall 30 and being constructed such that the miner 12, carriers 24 and associated equipment are movable through the caisson 78 into and from the coal seam 28 during the operation of the mining apparatus 10; a launching assembly 82 for moving the miner 12, carriers 24 and associated equipment through the caisson 78 and through the coal seam 28; a working fluid supply 84 for passing a working fluid through a conduit 86 and into a borehole 88 formed through the coal seam 28 via the miner 12; a compressed gas supply 90 for supplying the compressed gas to the mined material removal assembly 36 via the conduit 48, one end of the conduit 48 being connected to the mined material removal assembly 36 and the opposite end of the conduit 48 being connected to the compressed gas supply 90; a mined material transfer assembly 92 for receiving the mined material passed from the mined material removal assembly 36 through the conduit 46 and passing or transferring the mined material through a conduit 94 to the auxiliary assembly 76 where the mined material is recovered, one end of the conduit 46 being connected to the mined material removal assembly 36 and the opposite end of the conduit 46 being connected to the mined material transfer assembly 92; an electrical power supply 96 for supplying the operating electrical power to the miner 12 via a cable 98; and a control unit 100, which receives the signal on the control line 34 provided via the sensor assembly 32 and provides the signal on the control line 60 in response thereto for positioning the forward cutter 52 to guide the miner 12 through the coal seam 28, the control unit 100 also providing the signals on the control lines 56, 68 and 72. The valves 40 and 44 each have opened and closed positions and the position of each of the valves 40 and 44 is remotely controllable in response to signals provided on control lines 102 and 104, respectively, the signals on the control lines 102 and 104 being provided via the control unit 100.

It should be noted that the gas injected into the slurry is the primary means for moving the slurry from the excavation site to the remote or surface location and the mined material transfer assembly 92 can include an auxiliary slurry pump for pumping the mined material to the surface, in which case the auxiliary slurry pump cooperating with the gas injection to effect the moving of the mined material to the surface. One of the reasons for including the slurry pump is that gas injection alone will not operate to move the slurry to the surface in all operational applications.

The auxiliary assembly 76 includes a separator 106, which receives the slurry comprising the working fluid, the mined material and the gas passed from the mined material transfer assembly 92 via the conduit 94, the slurry being separated in the separator 106. The mined material separated from the slurry is transferred to a mined material preparation and storage 108 via a conduit or a conveyor or other such material transfer means, generally indicated via the path 109. The gas separated from the slurry is passed to a gas storage 110 via a conduit 112 and the working fluid separated from the slurry is passed to a working fluid production unit 114 via a conduit 116. The working fluid production unit 114 also receives materials for producing the working fluid via a conduit 118 and the working fluid so produced along with the re-cycled working fluid received via the conduit 116 provides a reservoir of the working fluid, the working fluid being passable from the working fluid production unit 114 to the working fluid supply 84 via a conduit 120. The working fluid may be of the type commonly referred to in the art as "drill mud" and used in connection with the drilling of oil or gas wells and the like, or the working fluid may be water or water loaded with fine coal or other fluid suitable for supporting the walls of the borehole 88 and for conveying the mined material through the mined material removal assembly 36 and the mined material transfer assembly 92 during the operation of the mining apparatus 10 as described herein.

In general, the surface assembly 26 is located at the surface generally near the highwall 30 and, more particularly, the caisson 78 is positioned at a predetermined location along the highwall 30, the end 80 of the caisson 78 being positioned in sealing engagement with the highwall 30 with the launching assembly 82 being positioned near the end of the caisson 78, opposite the end 80 thereof. The working fluid supply 84 is placed in fluidic communication with the borehole 88 to be formed via the miner 12 or, more particularly, the conduit 86 is connected to the caisson 78 so the working fluid can be passed through a portion of the caisson 78 and into the borehole 88. The control lines 34, 56, 60, 68, 72, 102 and 104 are each connected to the control unit 100 and to the appropriate assemblies of the miner 12, as shown in FIG. 2 and described before, the cable 98 is connected to the miner 12 (not shown) and to the electrical power supply 96, the conduit 46 is connected to the mined material removal assembly 36 and the mined material transfer assembly 92, and the conduit 48 is connected to the mined material removal assembly 36 and the compressed gas supply 90. In short, all of the hydraulic, pneumatic and electrical control lines, cables and conduits are connected to the miner 12 and the surface unit 74 so the surface unit 74 is operatively connected to the miner 12 prior to launching the miner 12 into the coal seam 28.

The miner 12 is positioned in the launching assembly 82 and oriented such that the coal seam 28 initially is engaged via the forward cutter assembly 16 as the miner 12 is launched into the coal seam 28. The launching assembly 82 is constructed to engage the miner 12 and force the miner 12 into the coal seam 28, the miner 12 being forced through the caisson 78 and into the coal seam 28 in a general direction 124 via the launching assembly 82. In addition, the launching assembly 82 is further oriented and constructed so that the forward end of the carrier 24 carrying the male couplers of the coupling assembly 25 can be initially contacted with the female couplers of the coupling assembly 25 carried by the rearward end 23 of the miner 12 at a substantially right angle, thereby positioning the coupling assembly 25 in the insert position, and thereafter lowered to a position substantially aligned with the longitudinal axis of the miner 12, thereby positioning the coupling assembly 25 in the connected position. The rearward end of the carrier 24 carrying the female couplers of the coupling assembly 25 (shown in FIGS. 6, 7, 9 and 10) is adapted to be connected to the forward end of one of the other carriers 24 carrying the male couplers of the coupling assembly 25 in a similar manner. Details of the coupling assembly 25 will be described below with reference to FIGS. 4, 6, 7 and 9 to 16.

When the miner 12 initially is launched into the coal seam 28, the control unit 100 provides a signal on the control line 56 and the forward cutter drive assembly 54 rotatingly drives the forward cutter 52 in response to receiving the signal from the control unit 100 on the control line 56. In this operating mode, the control unit 100 provides a signal on the control line 102 and the valve 40 is positioned in the opened position in response to receiving the signal from the control unit 100 on the control line 102, thereby providing communication between the forward cutter assembly 16 and the mined material removal assembly 36 via the conduit 38. The control unit 100 provides a signal on the control line 104 and the valve 44 is positioned in the closed position in response to receiving this signal on the control line 104 in this operating mode of the miner 12, thereby interrupting communication between the rearward cutter assembly 20 and the mined material removal assembly 36. The control unit 100 provides a signal on the control line 68 and the rearward cutter drive assembly 66 is conditioned such that the rearward cutter 64 is not rotatingly driven as the miner 12 is moved through the coal seam 28 in the direction 124. The control unit 100 provides the signal on the control line 72 and the rearward cutter positioning assembly 70 is conditioned to move the rearward cutter frame 62 and the rearward cutter 64 connected thereto to a storage position wherein the rearward cutter 64 does not excavatingly engage the coal seam 28 as the miner 12 is moved into the coal seam 28 in the direction 124. In summary, the control unit 100 is constructed to cause the rearward cutter assembly 20 to be positioned in the storage position and to cause the forward cutter 52 to be rotatingly driven via the forward cutter drive assembly 54 for excavatingly engaging the material (coal) to be mined when the miner 12 is being moved through the coal seam 28 in the direction 124.

Working fluid is passed into the borehole 88 from the working fluid supply 84 via the conduit 86, and the borehole 88 substantially is filled with the working fluid. The working fluid is maintained in the borehole 88 under a hydrostatic pressure and the hydrostatic pressure of the working fluid acting against the walls formed in the coal seam 28 via the borehole 88 cooperates to support the walls formed via the borehole 88 against falls or collapses during the excavation of the material (coal) from the coal seam 28. The working fluid is continuously passed into the borehole 88 from the working fluid supply 84 to maintain the borehole 88 filled with the working fluid as the borehole 88 is enlarged via the excavation and removal of the mined material (coal), and the working fluid is prevented from escaping or leaking through the opening formed in the highwall 30 via the sealing engagement between the caisson 78 and the highwall 30, the caisson 78 being constructed to maintain the sealing engagement with the highwall 30 as the miner 12 is passed through the caissson 78 and into the coal seam 28. The working fluid in the borehole 88 also is utilized to provide a vehicle for moving the mined or excavated material from the borehole 88 to the surface in a manner to be described in greater detail below.

When the miner 12 is being moved into and through the coal seam 28, the forward cutter 52 excavatingly engages the material (coal) to be mined and dislodges or disengages the material (coal) from the coal seam 28. The excavated material (coal) is suspended in the working fluid and the mined material (coal) and the working fluid form a slurry, the slurry of the mined material (coal) and the working fluid being moved via the forward cutter assembly 16 into the conduit 38 as the material is excavated from the coal seam 28 via the forward cutter 52. The slurry including the material (coal) excavated via the forward cutter 52 is passed through the conduit 38 into the mined material removal assembly 36 where compressed or pressurized gas, which may be air, methane, the exhaust from a diesel engine or some other gas or the like, for example, is injected into the slurry, the pressurized gas providing flotation assistance for maintaining the mined material (coal) suspended throughout the working fluid, thereby facilitating or assisting the pumping or moving of the slurry from the miner 12 to the surface assembly 26.

The slurry comprising the mined material (coal), the working fluid and the pressurized gas is passed from the mined material removal assembly 36 through the conduit 46 to the mined material transfer assembly 92 of the surface unit 74. The slurry received via the mined material transfer assembly 92 is passed to the separator 106 of the auxiliary assembly 76 via the conduit 94 wherein the slurry is separated into a working fluid component, a gas component, and a mined material (coal) component. The gas component is passed from the separator 106 into the gas storage 110 via the conduit 112 and thus the gas injected into the slurry is recovered for recycling back into the compressed gas supply 90 via the conduit 112. Make-up gas can be supplied to either the gas storage 110 or directly to the compressed gas supply 90 for assuring a sufficient supply of gas in the event a sufficient supply is not recovered from the slurry in the separator 106 for recycling to the compressed gas supply 90. The working fluid component is passed from the separator 106 to the working fluid production unit 114 via the conduit 116 where the recovered working fluid is added to and mixed with make-up working fluid passed into the working fluid production unit 114 via the conduit 118, the working fluid produced and retained within the working fluid production unit 114 being passed to working fluid supply 84 via the conduit 120 for supplying the working fluid to be passed into the borehole 88 from the working fluid supply 84 via the conduit 86. The mined material (coal) component is passed from the separator 106 via the path 109 into the mined material preparation and storage 108.

As the miner 12 is forced into and through the coal seam 28 via the launching assembly 82 in the direction 124, the sensor assembly 32 senses or detects the coal seam 28 interface and provides the signal or signals on the control line 34 indicating the position of the coal seam 28 interface relative to the position of the sensor assembly 32, the output signal or signals provided via the sensor assembly 32 indicating the position of the miner 12 relative to the coal seam 28 interface since the sensor assembly 32 is mounted on the miner 12. More particularly, the sensor assembly 32 is mounted on the miner 12 in a predetermind position relative to the forward cutter 52 and the frame 14 so that the output signal or signals provided via the sensor assembly 32 indicate the position of frame 14 relative to the coal seam 28 interface.

The control unit 100 provides the output signal or signals on the control line 60 in response to the signals received from the sensor assembly 32 on the control line 34. The forward cutter positioning assembly 58 causes the foward cutter frame 50 and the forward cutter 52 connected thereto to be moved to predetermined positions in response to the signals received from the control unit 100 on the control line 60. More particularly, the forward cutter positioning assembly 58 moves the forward cutter frame 50 about a vertical and horizontal axes to position the forward cutter 52 in predetermined positions relative to the coal seam 28 interface. The sensor assembly 32, the control unit 100 and the forward cutter positioning assembly 58 cooperate to position the forward cutter 52 in predetermined positions for steering and guiding the miner 12 through the coal seam 28 in a manner such that the miner 12 maintains a substantially constant position relative to the coal seam 28 interface as the miner 12 is moved into and through the coal seam 28 in the direction 124.

When it is desired to withdraw the miner 12 from the borehole 88 in a withdrawal direction 126, the control unit 100 provides a signal to the forward cutter drive assembly 54 via the control line 56 and the forward cutter drive assembly 54 ceases driving the forward cutter 52 in response to the received signal on the control line 56 in this operating withdrawal mode of the mining apparatus 10. Then, the control unit 100 provides a signal to the rearward cutter positioning assembly 70 on the control line 72 and the rearward cutter positioning assembly 70 moves the rearward cutter frame 62 and the rearward cutter 64 connected thereto from the storage position to a material engaging position (diagrammatically shown in dashed-lines in FIG. 2) in response to receiving this signal on the control line 72. In the material engaging position of the rearward cutter assembly 20, the rearward cutter 64 is positioned to excavatingly engage a portion of the coal seam 28 which was not engaged via the forward cutter 52 during the movement of the miner 12 into and through the coal seam 28 in the direction 124. Thus, the rearward cutter 64 excavates additional material (coal) from the coal seam 28, thereby enlarging the borehole 88, as the miner 12 is withdrawn from the borehole 88 in the withdrawal direction 126. It should be noted that the rearward cutter 64 also is utilized to assist in withdrawing the miner 12 from the borehole 88 by effectively cutting the miner 12 out from the borehole 88 in the event the walls or roof or portions thereof formed in the coal seam 28 via the borehole 88 fall or collapse between the miner 12 and the surface.

Prior to providing the signal for positioning the rearward cutter 64 in the material engaging position, the control unit 100 provides a signal to the rearward cutter drive assembly 66 on the control line 68 and the rearward cutter drive assembly 66 rotatingly drives the rearward cutter 64. In this manner, the rearward cutter 64 excavatingly engages the coal seam 28 as the rearward cutter 64 is moved into the material engaging position.

Further, before the rearward cutter assembly 20 is positioned in the material engaging position, the control unit 100 provides a signal on the control line 102 and the valve 40 is positioned in the closed position in response to receiving this signal provided on the control line 102, thereby interrupting communication between the forward cutter assembly 16 and the mined material removal assembly 36. The control unit 100 provides a signal on the control line 104 and the valve 44 is positioned in the opened position in response to receiving this signal on the control line 104, thereby establishing communication between the rearward cutter assembly 20 and the mined material removal assembly 36 via the conduit 42.

After the rearward cutter assembly 20 has been positioned in the material engaging position, the miner 12 is withdrawn from and through the coal seam 28 via the launching assembly 82 in the withdrawal direction 16. As the miner 12 is moved in the withdrawal direction 126, the rearward cutter 64 excavatingly engages the material (coal) to be mined and dislodges or disengages the material (coal) from the coal seam 28. The excavated material (coal) is suspended in the working fluid and the mined material (coal) and the working fluid form a slurry, the slurry of the mined material (coal) and the working fluid being moved via the rearward cutter assembly 20 into the conduit 42 as the material is excavated from the coal seam 28 via the rearward cutter 64. The slurry including the material (coal) excavated via the rearward cutter 64 is passed through the conduit 42 into the mined material removal assembly 36 where compressed or pressurized gas (or air) is injected into the slurry in a manner and for reasons described before with respect to the material (coal) excavated via the forward cutter assembly 16.

The miner 12 is steered into and through the coal seam 28 in the direction 124 via the sensor assembly 32, the control unit 100 and the forward cutter positioning assembly 58 in a manner generally described before. The control unit 100 is constructed to store the information received from the sensor 32 via the control line 34 and to store the information provided to forward cutter positioning assembly 58 via the control line 60 during the mode of operation where the miner 12 is driven into and through the coal seam 28 in the direction 124. During the withdrawal of the miner 12 the control unit 100 utilizes the information stored therein to produce signals on the control line 60 which cause the forward cutter positioning assembly 58 to move the forward cutter frame 50 and the forward cutter 52 connected thereto for steering and guiding of the miner 12 into and through the coal seam 28 in the withdrawal direction 126 along the substantially corresponding to the path followed by the miner 12 during the movement of the miner 12 into and through the coal seam 28 in the direction 124. Thus, during the withdrawal of the miner 12 in the withdrawal direction 126, the forward cutter positioning assembly 58, the forward cutter frame 50 and the forward cutter 52 cooperate to steer and guide the miner 12 along a path substantially corresponding to the path followed by the miner 12 during the movement of the miner 12 into and through the coal seam 28 in the direction 124. It should be noted that the forward cutter assembly 16 does not function to excavatingly engage the material (coal) while moving the miner 12 in the direction 126; however, the forward cutter assembly 16 does function to steer and guide the miner 12 along a path determined via the control unit 100 output signals on the control line 60 which are connected to and received by the forward cutter positioning assembly 58, the forwardly cutter positioning assembly 58 positioning the forward cutter frame 50 and the forward cutter 52 connected thereto in response to the output signals received on the control line 60 from the control unit 100.

The slurry comprising the material (coal) excavated via the rearward cutter 64, the pressurized gas and the working fluid is passed from the mined material removal assembly 36 through the conduit 46 to the mined material transfer assembly 92 of the surface unit 74. The working fluid, the material (coal) excavated via the rearward cutter 64 and the pressurized gas is recovered from the slurry in the separator 106 in a manner and for reasons like those described before with respect to the material (coal) excavated via the forward cutter assembly 16.

Referring now to FIGS. 6–10, in combination with FIG. 1, the mining apparatus 10 includes a plurality of carriers 24, and each carrier 24 includes a carrier frame 130 having a forward end 132, a rearward end 134 and a coupling assembly 25. The forward end 132 of each carrier frame 130 is provided with a male coupler 135. The rearward end 134 of each carrier frame 130 and the rearward end 23 of the miner 12 are each provided with a female coupler 137, the male coupler 135 and the female coupler 137 being constructed and positioned so that the forward end 132 of each carrier frame 130 is connectable either to the rearward end 134 of another carrier frame 130 or to the rearward end 23 of the miner 12. The male coupler 135 and the female coupler 137 are constructed to permit the easy assembly of the carriers 24 while substantially preventing the undesired disconnecting of the carrier 24 from the miner 12 or from another carrier 24 within the borehole 88.

After the miner 12 has been moved a distance into the coal seam 28, the forward end 132 of the carrier frame 130 of one of the carriers 24 having the male coupler 135 thereon is positioned by the launching assembly 82 adjacent the rearward end 23 of the miner 12 having the female coupler 137 of the coupling assembly 25 thereon so that the longitudinal axis common to the carrier 24 and the male coupler 135 of the coupling assembly 25 is substantially perpendicular to the longitudinal axis common to the miner 12 and the female coupler 137 of the coupling assembly 26. Thereafter, the launching assembly 82 lowers the carrier 24 in the downwardly, perpendicular direction with respect to the longitudinal axis of the miner 12 and the female coupler 137 of the coupling assembly 25 so that the male coupler 135 carried by the forward end 132 of the carrier frame 130 of the carrier 24 engages the female coupler 137 carried by the rearward end 23 of the miner 12 as shown by the phantom lines in FIG. 9. Once the male coupler 135 has engaged the female coupler 137 of the coupling assembly 25 as set forth above, the launching assembly 82 pivotably lowers the carrier 24, while maintaining the before mentioned engagement of the male coupler 135 with the female coupler 137 of the coupling assembly 25, to a position wherein the longitudinal axis of the miner 12 is substantially aligned with the longitudinal axis of the carrier frame 130 of the carrier 24, and the miner 12 and the carrier 24 are operatively connected together through the union of the male coupler 135 and the female coupler 137 of the coupling assembly 25 as shown in FIG. 10. Then, the launching assembly 82 engages a portion of the carrier 24 which is connected to the miner 12 and the launching assembly 82 forces the engaged carrier 24 into the coal seam 28 or, more particularly, into the borehole 88, thereby forcing the miner 12 connected thereto into and through the coal seam 28 in the direction 124.

After the miner 12 and the carrier 24 connected thereto have been forcibly moved a distance into and through the coal seam 28 via the launching assembly 82, the forward end 132 of a second carrier 24 having the male coupler 135 thereon is connected to the rearward end 132 of the first carrier 24 having the female coupler 137 thereon by positioning the male coupler 135 of the second carrier 24 adjacent the female coupler 137 of the first carrier 24 so that the longitudinal axis common to the male coupler 135 is substantially perpendicular to the longitudinal axis common to the female coupler 137. The second carrier 24 is then lowered, while still in the substantially perpendicular position with respect to the first carrier 24, so that the male coupler 135 on the second carrier 24 engages the female coupler 137 on the first carrier 24. Thereafter, the second carrier 24 is pivotably lowered, while maintaining the male coupler 135 on the second carrier 24 in the before mentioned engaging position with the female coupler 137 on the first carrier, so the carrier frame 130 of the second carrier 24 is substantially aligned with the carrier frame 130 of the first carrier 24 and the first carrier 24 is operatively connected to the second carrier 24 through the union of the male coupler 135 and the female coupler 137 of the coupling assembly 25. Then, the launching assembly 82 engages a portion of the second carrier 24 which has been connected to the first carrier 24 and the launching assembly 82 forces the engaged second carrier 24 into the borehole 88, thereby forcing the miner 12 into and through the coal seam 28 in the direction 124.

The carriers 24 are connected in an end-to-end relationship by the coupling assembly 25. The launching assembly 82 engages a portion of the last connected carrier frame 130 and forces the engaged carrier 24 and the carriers 24 connected thereto and the miner 12 into and through the coal seam 28 in the direction 124.

The carriers 24 are connected via coupling assembly 25 to the miner 12 and the miner 12 is forcibly moved into and through the coal seam 28 in the direction 124 via the force applied to last connected carrier 24 and transmitted to the miner 12 through the carriers 24 connected thereto. The connecting of additional carriers 24 in series to the miner 12 is repeated and continued until the miner 12 has been moved some predetermined distance through the coal seam 28.

After the miner 12 has been moved the predetermined distance into and through the coal seam 28 in the direction 124, the miner 12 is withdrawn from the borehole 88 and the rearward cutter 64 excavatingly engages the coal seam 28 for excavating additional material (coal) as the miner 12 is withdrawn in the withdrawal direction 126. During the withdrawal of the miner 12, the launching assembly 82 engages one of the carriers 24 and forces the engaged carrier 24 in the withdrawal direction 126, this force being transmitted to the miner 12 via the carriers 24 and the coupling assemblies 25 for forcibly moving the miner 12 through the coal seam 28 in the withdrawal direction 126.

Figure 9:
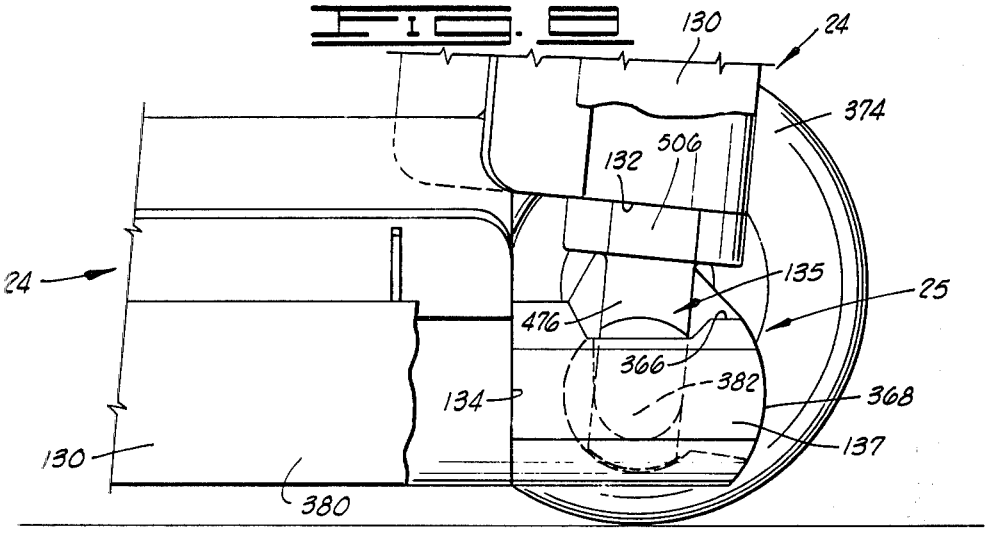
FIG. 9 is a side elevational view showing a portion of two carriers and illustrating the movement of the coupling assembly from an insert position toward a connected position.
Figure 10:
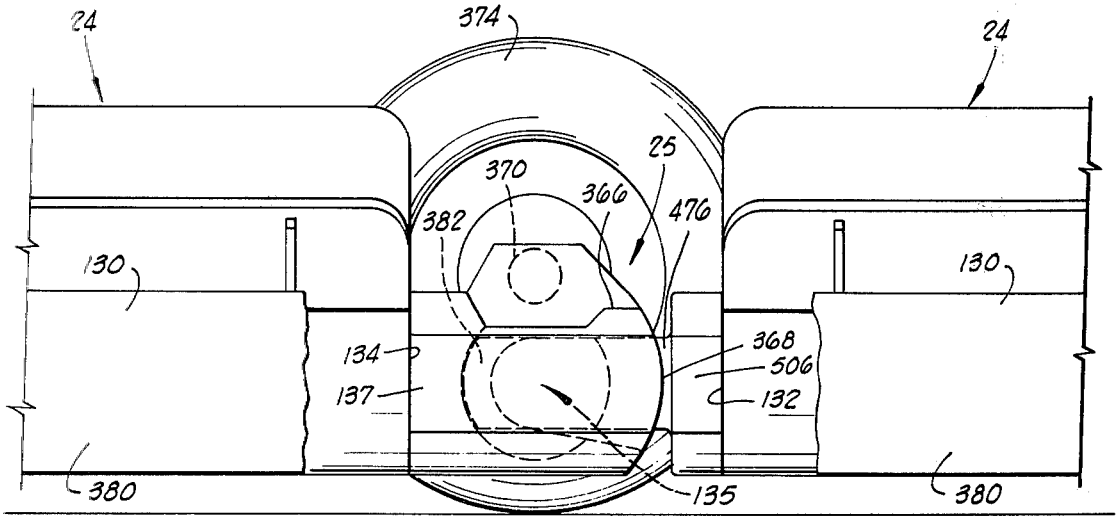
FIG. 10 is a side elevational view showing a portion of two carriers and showing the coupling assembly in a connected position.

After the miner 12 and the carriers 24 connected thereto have been moved a predetermined distance in the withdrawal direction 126, the last connected carrier 24, which is in a position to be disconnected, is pivotably raised upward by the launching assembly 82 until the longitudinal axis of the carrier frame 139 of the last connected carrier 24 is substantially perpendicular to the longitudinal axis of the carrier frame 130 of the carrier 24 to which it is connected (see FIG. 9). Thereafter, the launching assembly 82 lifts the last connected carrier 24 upwardly until the male coupler 135 of the coupling assembly 25 of the last connected carrier 24 is completely disengaged from the female coupler 137 of the carrier 24 to which the last connected carrier 24 has previously been connected. It should be noted that the structure and design of the male coupler 135 and the female coupler 137 of the coupling assembly 25, which will be discussed in detail hereinafter, enables the coupling assembly 25 to function as the pivot for the pivotably raising and lowering of one of the carriers 24 with respect to another carrier 24 when such carriers 24 are being disconnected or connected. After removal of the disconnected carrier 24, the launching assembly 28 is positioned in engagement with the carrier 24, which was connected to the carrier 24 just disconnected and removed and the carriers 24 are driven via the launching assembly 82 in the withdrawal direction 126 through the caisson 78. As each carrier 24 is driven through the launching assembly 82 in the withdrawal direction 126, the carrier 24 is disconnected and removed in the manner described before. The driving of the carriers 24 via the launching assembly 82 in the withdrawal direction 126 and the sequential disconnecting of the carriers 24 as the carriers 24 are passed or driven through the launching assembly 82 in the withdrawal direction 126 is continued until the miner 12 has been withdrawn from the borehole 88.

The particular number of carriers 24 utilized in a particular operation will depend upon the total length of the borehole 88 and the length of each of the individual carriers 24, between the forward and the rearward ends 132 and 134.

As diagrammatically shown in FIG. 1, the launching assembly 82 includes a portable crane 142 and a carrier track 144. The carrier track 144 comprises a plurality of structural members interconnected to a path for accommodating the carriers 24, the carrier track 144 having one open end 146 for receiving the carriers 24 and an opposite end (not shown) which is connected to the caisson 78. During the operation, each carrier 24 is loaded into the open end 146 of the carrier track 144 via the crane 142 and each carrier 24 then is positioned and guided through the carrier track 144 for connection via coupling assembly 25 to the miner 12 or to one of the previously connected carriers 24 in the manner described before.

It should be noted that, since the borehole 88 is filled with working fluid and the working fluid is sealed in the borehole 88 via the caisson 78, a hydrostatic head will exist on the forward cutter 52 and on the rearward cutter 64 during the cutting operations wherein the coal seam 28 is excavatingly engaged via the forward or the rearward cutters 52 or 64, and this hydrostatic head will exist on the forward cutter 52 even at the start of the operations where the miner 12 initially is launched into the coal seam 28. The hydrostatic pressure head on the forward and the rearward cutters 52 and 64 augments and facilitates the cutting operations.

Figure 5:
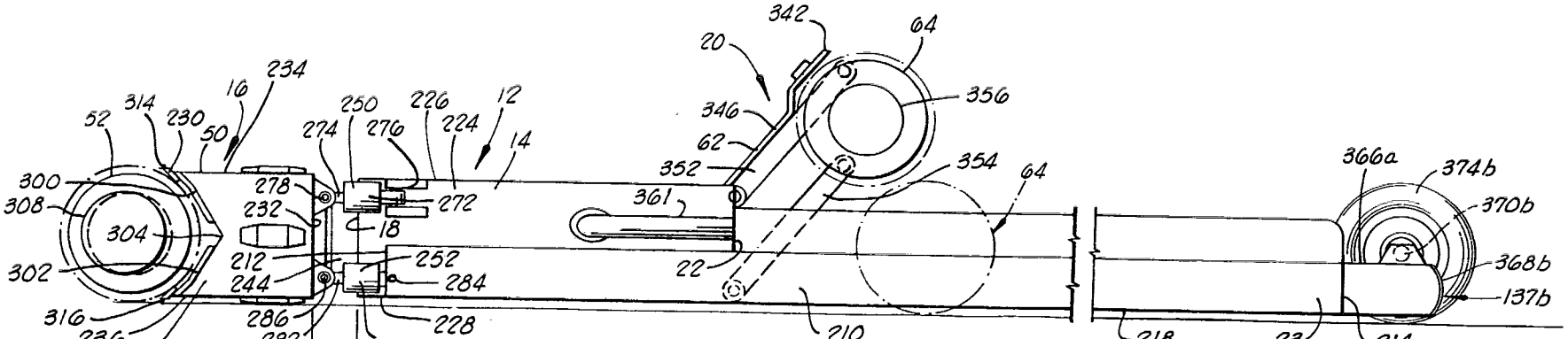
FIG. 5 is a side elevational view of the miner and FIGS. 3 and 4 showing the opposite side of the miner relative to the side of the miner shown in FIG. 3.
Figure 4:
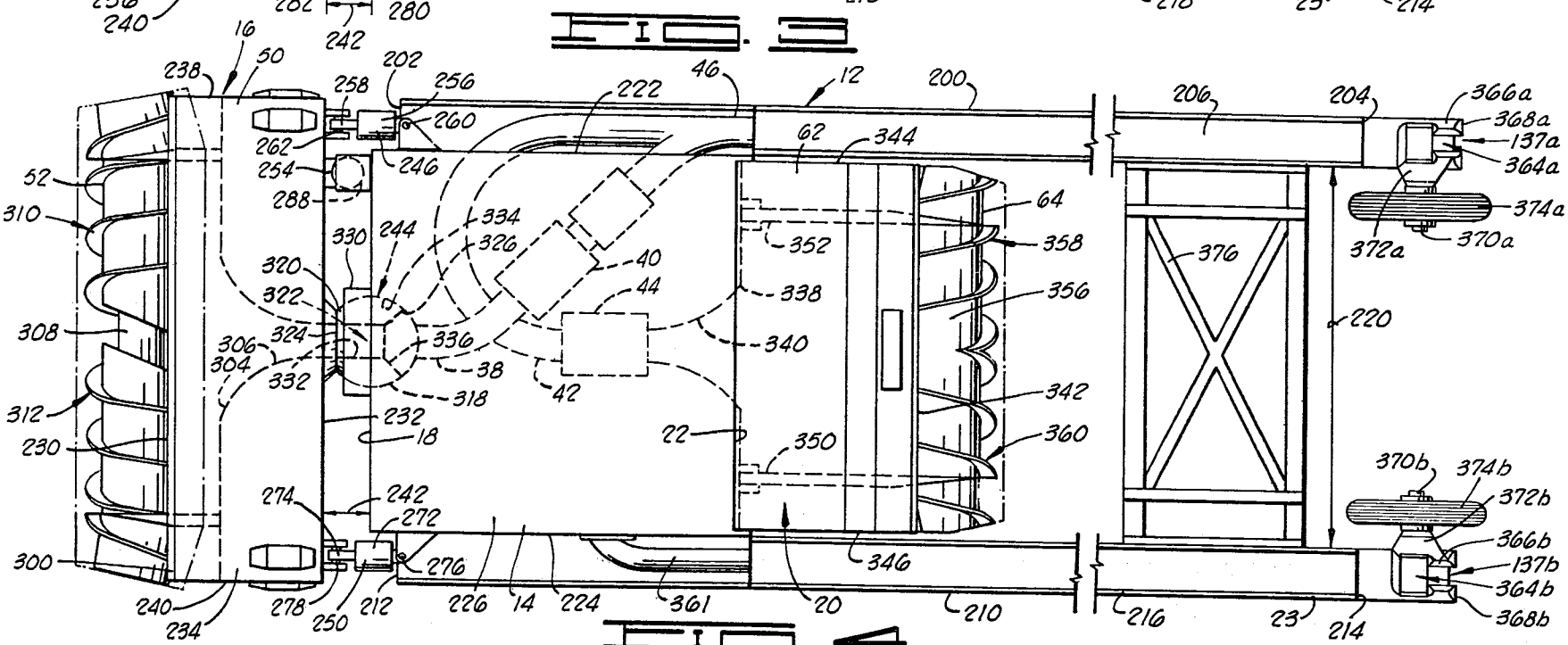
FIG. 4 is a plan view of the miner of FIG. 3.
Figure 5:
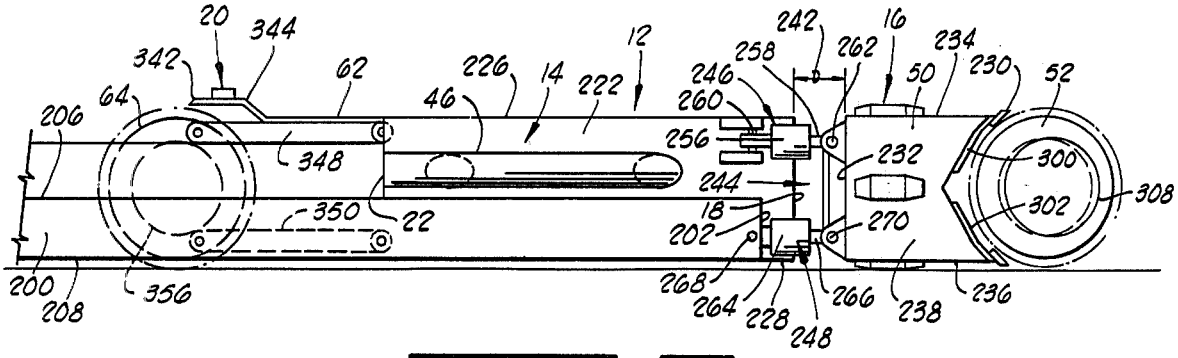

Referring to FIGS. 3, 4 and 5, the miner 12 includes: a first beam 200, having a forward end 202, a rearward end 204, an upper surface 206 and a lower surface 208; and a second beam 210, having a forward end 212, a rearward end 214, an upper surface 216 and a lower surface 218, the second beam 210 being spaced a distance 220 from the first beam 200 and extending generally parallel with respect to the disposition of the first beam 200. The frame 14 also has a first side 222, a second side 224, an upper side 226 and a lower side 228. The distance 220 is sized such that the first beam 200 is disposed near one of the walls formed in the coal seam 28 via the borehole 88 and such that the second beam 210 is disposed near another wall formed in the coal seam 28 via the borehole 88 during the operation as the miner 12 is moved into and withdrawn from the coal seam 28. The spacing of the first and second beams 200 and 210 in this manner substantially protects the beams 200 and 210 from "roof falls" where a portion of the roof formed in the coal seam 28 via the borehole 88 collapses and falls into the borehole 88, since such falls generally occur near the mid-portion of the borehole roof rather than near the sides.

The frame 14 is disposed and supported generally between the first and the second beams 200 and 210 with the first side 222 of the frame 14 being disposed generally adjacent a portion of the first beam 200, generally near the forward end 202 of the first beam 200, and the second side 224 of the frame 14 being disposed generally adjacent a portion of the second beam 210, generally near the forward end 212 of the second beam 210. In this position, the first beam 200 is secured to the first side 222 of the frame 14 and the second beam 210 is secured to the second side 224 of the frame 14, the lower side 228 of the frame 14 being disposed in a plane generally coplanar with respect to the planar disposition of the lower surfaces 208 and 218 of the first and the second beams 200 and 210, respectively.

In the assembled position of the frame 14 and the first and the second beams 200 and 202, the forward end 18 of the frame 14 extends a distance beyond the forward ends 202 and 212 of the first and the second beams 200 and 210, respectively, and the rearward end 22 of the frame 14 is disposed generally between the forward ends 202 and 212 and the rearward ends 204 and 214 of the first and second beams 200 and 210, respectively. Further, in the assembled position of the frame 14 and the first and the second beams 200 and 210, the upper side 226 of the frame 14 is spaced a distance above the upper surfaces 206 and 216 of the first and the second beams 200 and 210, respectively.

The forward cutter frame 50 has a forward end 230, a rearward end 232, an upper side 234, a lower side 236, a first side 238 and a second side 240. The rearward end 232 of the forward cutter frame 50 is positioned generally near and spaced a distance 242 from the forward end 18 of the frame 14. The rearward end 232 of the forward cutter frame 50 is movably connected to the forward end 18 of the frame 14 via a universal connection 244, a portion of the universal connection 244 being connected to the rearward end 232 of the forward cutter frame 50 and a portion of the universal connection 244 being connected to the forward end 18 of the frame 14. The forward cutter frame 50 is movably positionable about axes defined by centerlines extending through the center of the pivotal connection between the frame 14 and the forward cutter frame 50 provided by the universal connection 244.

The forward cutter positioning assembly 58 includes a first steering cylinder 246, a second steering cylinder 248, a third steering cylinder 250, a fourth steering cylinder 252 and a roll cylinder 254. Each of the cylinders 246, 248, 250, 252 and 254 are connected to the frame 14 and to the forward cutter frame 50 and operated in a manner for movably positioning the forward cutter frame 50 with respect to the frame 14 generally about pivotal axes defined via the universal connection 244. The steering cylinders 246, 248, 250 and 252 and the roll cylinder 254 are each operated to position the forward cutter frame 50 in predetermined positions with respect to the frame 14 and with respect to pivotal axes defined via the universal connection 244 as the miner 12 is launched into and through the coal seam 28 in the direction 124 and as the miner 12 is withdrawn through the coal seam 28 in the withdrawal direction 126.

The first steering cylinder 246, more particularly, comprises a hydraulically actuated type of cylinder and includes a cylinder base 256 and a piston rod 258, the piston rod 258 being movably mounted within the cylinder base 256 such that the piston rod 258 is moved outwardly a distance from the cylinder base 256 in one actuated condition of the first steering cylinder 246 and such that the piston rod 258 is moved inwardly a distance into the cylinder 256 in one other actuated condition of the first steering cylinder 246. The cylinder base 256 is pivotally connected to the frame 14 via a shaft 260, generally near the forward end 18 and generally near the first side 222 of the frame 14, the opposite ends of the shaft 260 each being securedly connected to the frame 14 and pivotally connected to the cylinder base 256 such that the cylinder base 256 is pivotally movable relative to the frame 14 about an axis generally defined via the centerline of the shaft 260. The end of the piston rod 258, opposite the end of the piston rod 258 which is connected to the cylinder base 256, is pivotally connected to the forward cutter frame 50 via a shaft 262, generally near the rearward end 232 and generally near the first side 238 and generally near the upper side 234 of the forward cutter frame 50, the piston rod 258 being pivotally movable relative to the forward cutter frame 50 about an axis generally defined via the centerline axis of the shaft 262. Thus, in one actuated position of the first steering cylinder 246, the piston rod 258 is moved outwardly a distance from the cylinder base 256 and, in this actuated condition, the first steering cylinder 246 exerts a force in the generally forward direction on the rearward end 232 of the forward cutter frame 50 generally near the upper side 334 and generally near the first side 238 of the forward cutter frame 50. In the one other actuated condition of the first steering cylinder 246, the piston rod 258 is moved inwardly a distance into the cylinder base 256 and, in this actuated condition, the first steering cylinder 246 exerts a force on the rearward end 232 of the forward cutter frame 50, generally near the upper side 234 and generally near the first side 238 of the forward cutter frame 50.

The second steering cylinder 248, more particularly, comprises a hydraulically actuated type of cylinder and includes a cylinder base 264 and a piston rod 266, the piston rod 266 being movably mounted within the cylinder base 264 such that the piston rod 266 is moved outwardly a distance from the cylinder base 264 in one actuated condition of the second steering cylinder 248, and such that the piston rod 266 is moved inwardly a distance into the cylinder base 264 in the one other actuated condition of the second steering cylinder 248. The cylinder base 264 is pivotally connected to the frame 14 via a shaft 268, generally near the forward end 18 and generally near the first side 222 and generally near the lower side 228 of the frame 14. Thus, the cylinder base 264 is pivotally movable relative to the frame 14 about an axis which generally corresponds to the centerline axis of the shaft 268, the shaft 268 being securedly connected to the frame 14 and pivotally connected to the cylinder base 264. The end of the piston rod 266, opposite the end of the piston rod 266 which is movably connected to the cylinder base 264, is pivotally connected to the rearward end 232 of the forward cutter frame 50, generally near the first side 238 and generally near the lower side 236 of the forward cutter frame 50, the piston rod 266 being pivotally connected to the forward cutter frame 50 via a shaft 270 such that the second steering cylinder 248 is movable relative to the forward cutter frame 50 about an axis generally corresponding to the centerline axis of the shaft 270. The second steering cylinder 248 is disposed generally below and spaced a distance from the first steering cylinder 246.

Thus, in one actuated position of the second steering cylinder 248, the piston rod 266 is moved outwardly a distance from the cylinder base 264 and, in this actuated condition, the second steering cylinder 248 exerts a force in the generally forward direction on the rearward end 232 of the forward cutter frame 50, generally near the lower side 236 and generally near the first side 238 of the forward cutter frame 50. In the one other actuated condition of the second steering cylinder 248, the piston rod 266 is moved inwardly a distance into the cylinder base 264 and, in this actuated condition, the second steering cylinder 248 exerts a force in the generally rearward direction on the rearward end 232 of the forward cutter frame 50, generally near the lower side 236 and generally near the first side 238 of the forward cutter frame 50.

The third steering cylinder 250, more particularly, comprises a hydraulically actuated type of cylinder and includes a cylinder base 272 and a piston rod 274, the piston rod 274 being movably mounted within the cylinder base 272 such that the piston rod 274 is moved outwardly a distance from the cylinder base 272 in one actuated condition of the third steering cylinder 250 and such that the piston rod 274 is moved inwardly a distance into the cylinder base 272 in one other actuated condition of the third steering cylinder 250. The cylinder base 272 is pivotally connected to the frame 14, generally near the second side 224 and generally near the forward end 18 and generally near the upper side 226 of the frame 14, via a shaft 276, the shaft 276 being securedly connected to the frame 14 and pivotally connected to the cylinder base 272, such that the third steering cylinder 250 is pivotally movable with respect to the frame 14 about an axis generally defined via the centerline axis of the shaft 276. The end of the piston rod 274, opposite the end of the piston rod 274 which is movably mounted within the cylinder base 272, is pivotally connected to the rearward end 232 of the forward cutter frame 50, generally near the second side 240 and generally near the upper side 234 of the forward cutter frame 50, via a shaft 278, the shaft 278 being securedly connected to the forward cutter frame 42 and pivotally connected to the piston rod 434 such that the forward cutter frame 50 is movable with respect to the frame 14 about an axis generally defined via the centerline axis of the shaft 278.

Thus, in one actuated position of the third steering cylinder 250, the piston rod 274 is moved outwardly a distance from the cylinder base 272 and, in this actuated condition, the third steering cylinder 250 exerts a force in the generally forward direction on the rearward end 232 of the forward cutter frame 50, generally near the upper side 234 and generally near the second side 240 of the forward cutter frame 50. In the one other actuated condition of the third steering cylinder 250, the piston rod 274 is moved inwardly a distance into the cylinder base 272 and, in this actuated condition, the third steering cylinder 250 exerts a force in the generally rearward direction on the rearward end 46 of the forward cutter frame 50, generally near the upper side 234 and generally near the second side 240 of the forward cutter frame 50.

The fourth steering cylinder 252, more particularly, comprises a hydraulically actuated type of cylinder and includes a cylinder base 280 and a piston rod 282, the piston rod 282 being movably mounted within the cylinder base 280 such that the piston rod 282 is moved outwardly a distance from the cylinder base 280 in one actuated condition of the fourth steering cylinder 252 and such that the piston rod 282 is moved inwardly a distance into the cylinder base 280 in one other actuated condition of the fourth steering cylinder 252.

The cylinder base 280 is connected to the frame 14 generally near the lower side 228 and generally near the forward end 18 and generally near the second side 224 of the frame 14, via a shaft 284, the shaft 284 being securedly connected to the frame 14 and journally connected to the cylinder base 280 such that the forward cutter frame 50 is movable relative to the frame 14 about an axis generally defined via the centerline axis of the shaft 284. The end of the piston rod 282, opposite the end of the piston rod 282 which is movably connected to the cylinder base 280, is pivotally connected to the rearward end 232 of the forward cutter frame 50, generally near the lower side 236 and generally near the second side 240 of the forward cutter frame 50, via a shaft 286, the shaft 286 being securedly connected to the forward cutter frame 50 and journally connected to the piston rod 450 such that the forward cutter frame 50 is movable relative to the frame 14 about an axis generally defined via the centerline axis of the shaft 286.

Thus, in one actuated condition of the fourth steering cylinder 252, the piston rod 282 is moved outwardly a distance from the cylinder base 280 and, in this actuated condition, the fourth steering cylinder 252 exerts a force on the rearward end 232 of the forward cutter frame 50, generally near the lower side 236 and generally near the second side 240 of the forward cutter frame 50. In the one other actuated condition of the fourth steering cylinder 252, the piston rod 282 is moved inwardly a distance into the cylinder base 280 and, in this actuated condition, the fourth steering cylinder 252 exerts a force in the generally rearward direction on the rearward end 232 of the forward cutter frame 50, generally near the lower side 236 and generally near the second side 240 of the forward cutter frame 50.

The roll cylinder, 254 more particularly, comprises a hydraulically actuated type of cylinder and includes a cylinder base 288 and a piston rod (not shown), the piston rod being movably mounted within the cylinder base 288 such that the piston rod is moved outwardly a distance from the cylinder base 288 in one actuated condition of the roll cylinder 254 and such that the piston rod is moved a distance inwardly into the cylinder base 288 in one other actuated condition of the roll cylinder 254. The cylinder base 288 is pivotally connected to the forward end 18 of the frame 14 generally near the first side 222 and generally between the upper and the lower sides 226 and 228 of the frame 14, via a shaft (not shown), the shaft being securedly connected to the frame 14 and journally connected to the cylinder base 288 such that the roll cylinder 254 is movable relative to the frame 14 about an axis generally defined via the centerline axis of the shaft. The end of the piston rod, opposite the end of the piston rod which is movably connected to the cylinder base 288, is pivotally connected to the rearward end 232 of the forward cutter frame 50, generally near the first side 238 and generally between the upper and the lower sides 234 and 236 of the forward cutter frame 50, via a shaft (not shown), the shaft being securedly connected to the forward cutter frame 50 and journally connected to the piston rod such that the roll cylinder 254 is movable relative to the forward cutter frame 50 about an axis generally corresponding to the centerline axis of the shaft.

Thus, in one actuated condition of the roll cylinder 254, the piston rod is moved outwardly a distance from the cylinder base 288 and, in this actuated condition, the roll cylinder 254 exerts a force in a direction generally from the upper side 234 toward the lower side 236 of the forward cutter frame 50 (or in other words, in a generally vertically downwardly direction) on the rearward end 232 of the forward cutter frame 50, generally near the first side 238 and generally between the upper and the lower sides 234 and 236 of the forward cutter frame 50. In the one other actuated condition of the roll cylinder 254, the piston rod is moved a distance inwardly into the cylinder base 288 and, in this actuated condition, the roll cylinder 254 exerts a force in a direction generally from the lower side 236 toward the upper side 234 of the forward cutter frame 50 (or, in other words, in a generally vertically upwardly direction) on the rearward end 232 of the forward cutter frame 50, generally near the first side 238 and generally between the upper and the lower sides 234 and 236 of the forward cutter frame 50.

The forward end 230 of the forward cutter frame 50 includes an inclined upper moldboard 300 and an inclined lower moldboard 302, the upper and the lower moldboards 300 and 302 each extending in a direction generally toward a central portion of the forward end 230 and in a direction generally from the forward end 230 toward the rearward end 232 of the forward cutter frame 50. The upper moldboard 300 extends a distance above the upper side 234 of the forward cutter frame 50 and the lower moldboard 302 extends a distance below the lower side 236 of the forward cutter frame 50.

An opening 304 is formed through a central portion of the forward end 230 of the forward cutter frame 50 and a passageway 306 is disposed within the forward cutter frame 50, one end of the passageway 306 being connected to the forward end 230 and encompassing the opening formed in the forward end 230 and the opposite end of the passage 306 being connected to the rearward end 232 of the forward cutter frame 50. The passageway 306 extends through a central portion of the forward cutter frame 50 generally between the first and the second sides 238 and 240 and generally between the upper and the lower sides 234 and 236.

A plurality of spaced bars or rods (not shown) can be secured to the forward end 230, each of the bars or rods extending across the opening 304 and cooperating to form a filter for restricting the size of the particles of mined material passing through the opening 304 and into the passageway 306. The forward cutter 52 operates to continually engage and crush the large particles of mined material until such particles have been crushed to a size sufficiently small to pass through the filter formed via the bars or rods and into the passageway 306.

The forward cutter 52 is disposed generally near the forward end 230 of the forward cutter frame 50 and the forward cutter 52 is journally mounted on the forward end 230 of the forward cutter frame 50.

The forward cutter 52 includes a cutter shaft 308 having a first flight of vanes 310 extending a distance generally radially from the cutter shaft 308 and extending helically about the cutter shaft 308 in generally clockwise direction, and a second flight of vanes 312 extending a distance generally radially from the cutter shaft 308 and extending helically about the cutter shaft 308 in a generally counterclockwise direction. The first flight of vanes 310 is oriented about the cutter shaft 308 to engage and move the excavated material (coal) generally toward the central portion of the forward end 230 in a direction generally from the first side 238 toward the second side 240, and the second flight of vanes 312 is oriented about the cutter shaft 308 to engage and move the excavated material (coal) generally toward a central portion of the forward end 230 in a direction generally from the second side 240 toward the first side 238. Thus, the first and the second flights of vanes 310 and 312 are oriented to engage and move the excavated material (coal) into the opening 304 formed in the forward end 230 of the forward cutter frame 50, the excavated material (coal) being moved into the opening 304 and through the passageway 306 as the miner 12 is being moved into and through the coal seam 28 in the direction 124. It should be noted that the vanes 310 and 312 act in the nature of pump during the operation of the forward cutter 52 for moving the slurry comprising the mined material and the working fluid into and through the passageway 306.

The upper moldboard 300 and the lower moldboard 302 are each oriented with respect to the forward cutter 52 such that the upper and the lower moldboards 300 and 302 cooperate to encompass a portion of the forward cutter 52 in a mounted position of the forward cutter 52 on the forward cutter frame 50. The upper moldboard 300 and the lower moldboard 302 are each sized with respect to the diameter of the forward cutter 52 such that a space 314 exists between the outermost end of the upper moldboard 300 and the adjacent portion of the coal seam 28 formed via the borehole 88 and such that a space 316 exists between the outermost end of the lower moldboard 302 and the adjacent portion of the coal seam 28 formed via the borehole 88. The spaces 314 and 316 form orifices between the moldboards 300 and 302 and adjacent portions of the coal seam. During the operation of the miner 12, the working fluid passes through the orifices formed via the spaces 314 and 316 between the moldboards 300 and 302 and the adjacent portions of the coal seam 28 formed via the borehole 88 and into the area generally about the forward cutter 52, the working fluid operating to facilitate the removal of the mined material in a manner described before. As the working fluid passes through the spaces 314 and 316, a pressure drop is created across the orifices formed via the spaces 314 and 316 and the pressure of the working fluid on one side of the orifices in a direction generally from the forward end 230 toward the rearward end 232 of the forward cutter frame 50 is greater than the pressure of the working fluid on the other side of the orifices in a direction generally from the rearward end 232 toward the forward end 230 of the forward cutter frame 50. This differential pressure drop across the orifices formed via the spaces 314 and 316 results in a component of force acting against the end face of the portion of the coal seam 28 formed via the borehole 88 which is excavatingly engaged via the forward cutter 52 and this component of force facilitates the cutting the material to be mined via the forward cutter 52. Further, the flow of the working fluid through the spaces 314 and 316 tends to move all of the mined material into the mined material removal assembly 36 and thus substantially reduces any loss of mined material as a result of leaving such lost mined material in the borehole 88.

In addition to the foregoing, the upper and the lower moldboards 300 and 302 cooperate with the forward end 230 of the forward cutter frame 50 to retain the material (coal) excavated via the forward cutter 52 within a space generally defined via the forward end 230 of the forward cutter frame 50 and the portion of the coal seam 28 which is being excavatingly engaged via the forward cutter 52. Thus, the forward end 230 of the forward cutter frame 50 is shaped to cooperate with the forward cutter 52 to assure that substantially all of the material (coal) excavatingly dislodged via the forward cutter 52 is moved into and through the passageway 306 as the miner 12 is moved in the direction 124 through the coal seam 28, the movement of the miner 12 through the coal seam 28 in the direction 124 cooperating with the forward cutter 52 to cause the material (coal) excavatingly dislodged via the forward cutter 52 to be moved through the passageway 306 in the forward cutter frame 50.

The universal connection 244 includes a spherically shaped member 318, having an outer surface 320, which is secured to the rearward end 232 of the forward cutter frame 50 at a position generally midway between the first and the second sides 238 and 240 of the forward cutter frame 50. A passageway 322 is formed through a central portion of the spherically shaped member 318, one end of the passageway 322 intersecting one portion of the spherically shaped member 318 and forming an opening 324 in the outer surface 320 of the member 318 and the opposite end of the passageway 322 intersecting a portion of the member 318 and forming an opening 326 extending through the outer surface 320 of the member 318. The member 318 is oriented on the forward end 320 of the forward cutter frame 50 such that the opening 324 is generally aligned with the passageway 306 extending through the forward cutter frame 50. One portion of the passageway 322, generally near the opening 326, is enlarged with respect to the remaining portion of the passageway 322 and thus the opening 326 is larger than the opening 324.

A housing 330 is connected to the forward end 18 of the frame 14 and an opening 332 is formed through the housing 330, the opening 332 being shaped to journally or bearingly engage a portion of the outer surface 320 of the spherically shaped member 318. An opening 334 is formed in a central portion of the forward end 18 of the frame 14 and the opening 334 is shaped to journally or bearingly engage a portion of the outer surface 320 of the member 318. In the assembled position, a portion of the member 318, generally opposite the portion of the member 318 which is connected to the forward cutter frame 50, is disposed in the opening 334 and the housing 330 extends about a portion of the member 318 or, more particularly the member 318 extends through the opening 322 formed in the housing 330. The opening 332 is aligned with the opening 334 in the frame 14 and the openings 332 and 334 cooperate to provide a bearing surface for engaging the member 318 as the member 318 is moved about axes defined via the universal connection 244. The housing 330 engages the member 318 and secures the member 318 in a connected position to the frame 14 while allowing the member 318 to be pivotally moved about the axes defined via the universal connection 244 during the operation of the miner 12.

The conduit 38 is disposed within a portion of the frame 14 and one end of the conduit 38 is supported generally adjacent the opening 326 formed through the member 318, the conduit 38 being in fluidic communication with the passageway 322 formed through the member 318 via the opening 326. The enlarged portion 336 of the passageway 322 is sized such that the opening 326 is larger than the opening through the conduit 38 and thus the enlarged portion 336 operates to maintain fluidic communication between the passageway 322 and the conduit 38 as the member 318 is pivotally moved about axes defined via the universal connection 244 during the operation of the miner 12.

As shown more clearly in FIG. 4, the conduit 38 extends through the frame 14 and the end of the conduit 38, generally opposite the end of the conduit 38 which is disposed near the universal connection 244, is connected to the conduit 46, a portion of the conduit 38 extending through the first side 222 of the frame 14. An opening 338 is formed through a central portion of the rearward end 22 of the frame 14, generally midway between the first and the second sides 222 and 224 of the frame 14. The conduit 42 and the valve 44 interpose in the conduit 42 are each disposed within a portion of the frame 14. A portion 340 of the conduit 42 is enlarged with respect to the remaining portion of the conduit 42 and the enlarged end portion of the conduit 42 is connected to the rearward end 22 of the frame 14, the conduit 42 being oriented such that the opening formed through the enlarged end portion of the conduit 42 is in fluidic communication with the opening 340 formed through the rearward end 22 of the frame 14. The end of the conduit 42, opposite the end connected to the rearward end 22 of the frame 14, extends through a portion of the frame 14 and passes through the second side 224 of the frame 14, the end of the conduit 42, opposite the end of the conduit 42 connected to the rearward end 22 of the frame 14, is connected to the conduit 46. Thus, the opening 338 and the conduit 42 provide a passageway which extends through a portion of the frame 14 and is connected to the conduit 46, the passageway provided via the opening 338 and the conduit 42 providing communication between the rearward end 22 of the frame 14 and the conduit 46, for reasons which will be made more apparent below.

One end of the rearward cutter frame 62 is pivotally connected to the rearward end 22 of the frame 14, and the rearward cutter frame 62 extends a distance generally from the rearward end 22 of the frame 14 terminating with an outer most end 342. The rearward cutter frame 62 has a first side 344 and a second side 346 and the rearward cutter frame 62 is disposed generally between the first and the second beams 200 and 210, the first side 344 of the rearward cutter frame 62 being disposed generally near the first beam 200 and the second side 346 of the rearward cutter frame 62 being disposed generally near the second beam 210 in the storage position of the rearward cutter assembly 20 (shown in dashed-lines in FIG. 3).

The rearward cutter 64 is pivotally connected to the rearward end 22 of the frame 14 and disposed generally between the first and the second beams 200 and 210. More particularly, the rearward cutter assembly 20 includes a first pair of pivot arms 348 and 350. One end of the pivot arm 348 is pivotally connected to the rearward end 22 of the frame 14 and the opposite end of the pivot arm 348 is pivotally connected to the rearward cutter 64. One end of the pivot arm 350 is pivotally connected to the rearward end 22 of the frame 14 and the opposite end of the pivot arm 350 is pivotally connected to the rearward cutter 64.

The rearward cutter assembly 20 also includes a second pair of pivot arms 352 and 354. One end of the pivot arm 352 is pivotally connected to the rearward end 22 of the frame 14 and the opposite end of the pivot arm 352 is connected to the rearward cutter 64. One end of the pivot arm 354 is pivotally connected to the rearward end 22 of the frame 14 and the opposite end of the pivot arm 354 is pivotally connected to the rearward cutter 64.

The pivot arms 348, 350, 352 and 354 cooperate to pivotally secure the rearward cutter 64 to the rearward end 22 of the frame 14. The pivot arms 348, 350, 352, and 354 are disposed generally between the first and the second beams 200 and 210 and, in the storage position of the rearward cutter assembly 20, the pivot arms 348, 350, 352 and 354 each extend a distance from the rearward end 22 of the frame 14 and each is disposed generally between the first and the second beams 200 and 210. In this embodiment, the pivot arms 348 and 350 structurally support the rearward cutter frame 62 and pivotally connect the rearward cutter frame 62 to the frame 14. A pair of rear cylinders (not shown) are connected to the rearward end 22 of the frame 14 and to the rearward cutter frame 62 for pivotally moving the rearward cutter assembly 32 to a storage position and to a material engaging position.

The rearward cutter 64 includes a cutter shaft 356 having a first flight of vanes 358 extending a distance generally radially from the cutter shaft 356 and extending helically about the cutter shaft 356 in a generally counterclockwise direction, and a second flight of vanes 360 extending a distance generally radially from the cutter shaft 356 and extending helically about the cutter shaft 356 in generally a clockwise direction. The first flight of vanes 358 is oriented about the cutter shaft 356 to engage and move the excavated material (coal) generally toward a central portion of the rearward end 22 of the frame 14 in a direction generally from the first side 222 toward the second side 224, and the second flight of vanes 360 is oriented about the cutter shaft 356 to engage and move the excavated material (coal) generally toward the central portion of the rearward end 22 in a direction generally from the second side 224 toward the first side 222. Thus, the first and the second flights of vanes 358 and 360 are oriented to engage and move the excavated material (coal) into the opening 338 formed in the rearward end 22 of the frame 14, the excavated material (coal) being moved into the opening 338 and through the passageway defined via the conduit 42 as the miner 12 is being moved through the coal seam 28 in the withdrawal direction 126.

The conduit 46 extends along the first beam 200 and terminates with a threaded end (not shown), which is disposed generally near the rearward end 204 of the first beam 200. One end of a conduit 361 is connected to the frame 14 and the conduit 361 extends along the second beam 210 terminating with a threaded end (not shown), which is disposed generally near the rearward end 214 of the second beam 210. The various control lines 34, 56, 60, 68, 72, 98, 102 and 104 extend through conduit 361 from the surface unit 74 to various components and assemblies of the miner 12.

As previously stated, the coupling assembly 25 comprises the male coupler 135 and the female coupler 137. Because of the construction of the miner 12 and the carriers 24, it is desirable that two of the female couplers 137 be secured to one end of each carrier 24 and that two male couplers 135 be secured at the opposed end of each carrier 24. Further, either two male couplers 135 or two female couplers 137 can be secured to the rearward end 23 of the miner 12 which are aligned for engagement with the opposite couplers 135 or 137 carried by one of the carrier 24. Generally, because of improving the ease of attachment, the rearward end 23 of the miner 12 is provided with the female couplers 137 of the coupling assembly 25. When describing the use of two coupler assemblies 25 for the attachment of a carrier 24 to either the rearward end 23 of the miner 12 or to a second carrier 24, the two coupling assemblies 25 will be referred to as the coupling assembly 25(*a*) and the coupling assembly 25(*b*) and each component will be designated with the (*a*) or (*b*) suffix in a similar manner.

Figure 6:
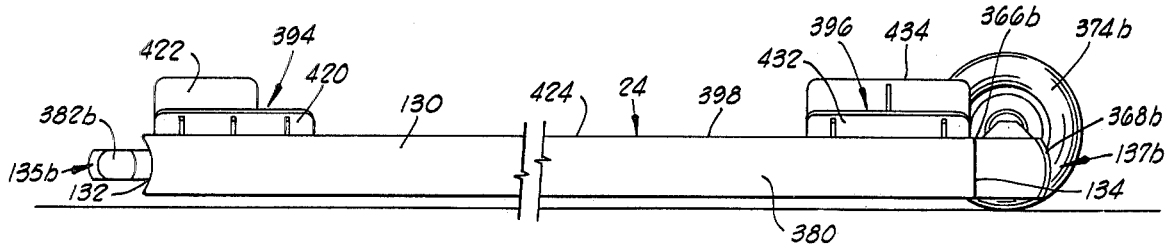
FIG. 6 is a side elevational view of a typical carrier showing the coupling assembly of the present invention.
Figure 7:
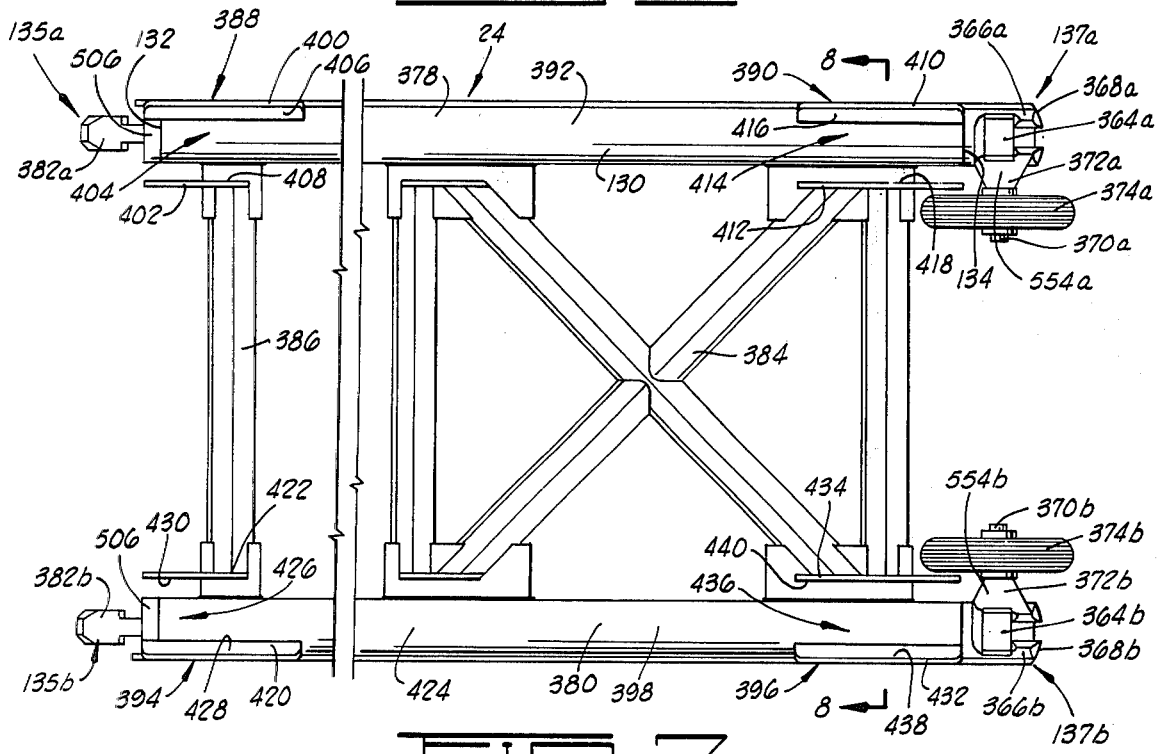
FIG. 7 is a plan view of the carrier of FIG. 6.

Referring now to FIGS. 4, 6 and 7, a female coupler 137(*a*) of the coupling assembly 25(*a*) is secured to the rearward end 204 of the first beam 200 of the miner 12 and a female coupler 137(*b*) of the coupling assembly 25(*b*) is secured to the rearward end 214 of the second beam 210 of the miner 12, the female couplers 137(*a*) and 137(*b*) being disposed rearwardly from the rearward ends 204 and 214 of the first beam 200 and the second beam 210, respectively, so that a substantially T-shaped slot 364(*a*) formed within the female coupler 137(*a*) and a substantially T-shaped slot 364(*b*) formed within the female coupler 137(*b*) are adapted to slidably receive the male coupler 135(*a*) and 135(*b*), respectively, in a manner to be described below.

The T-shaped slot 364(*a*) intersects an upper side 366(*a*) and the rearward end 368(*a*) of the female coupler 137(*a*) of the coupling assembly 25(*a*). In a similar manner, the T-shaped slot 364(*b*) intersects the upper side 366(*b*) and the rearward end 368(*b*) of the female coupler 137(*b*) of the coupling assembly 25(*b*). The female coupler 137(*b*) of the coupling assembly 25(*a*) is secured to the rearward end 204 of the first beam 200 of the miner 12 and oriented so that the central longitudinal axis of the first beam 200 substantially is aligned with the central longitudinal axis of the female coupler 137(*a*); and the female coupler 137(*b*) of the coupling assembly 25(*b*) is secured to the rearward end 214 of the second beam 210 of the miner 12 and oriented so that the central longitudinal axis of the second beam 210 substantially is aligned with the central longitudinal axis of the female coupler 137(*b*).

One end of an axle 370(*a*) is connected to a first side 372(*a*) of the female coupler 137(*a*) of the coupling assembly 25(*a*), and one end of an axle 370(*b*) is connected to a first side 372(*b*) of the female coupler 137(*b*) of the coupling assembly 25(*b*), the axles 370(*a*) and 370(*b*) extending generally perpendicularly from the sides 372(*a*) and 372(*b*) of the female couplers 137(*a*) and 137(*b*), respectively, in a direction towards one another. The axis of the axle 370(*a*) substantially is aligned with the axis of the axle 370(*b*), the axles 370(*a*) and 370(*b*) having substantially common parallel axes.

A wheel 374(*a*) is bearingly mounted on the axle 370(*a*) and disposed generally near the female coupler 137(*a*). A wheel 374(*b*) is bearingly mounted on the axle 370(*b*) and disposed generally near the female coupler 137(*b*). The wheels 374(*a*) and 374(*b*) cooperate to reduce friction and to rollingly support the rearward end 23 of the miner 12. Further, the attachment of the wheels 374(*a*) and 374(*b*) to the female couplers 137(*a*) and 137(*b*) of the coupling assemblies 25(*a*) and 25(*b*) via axles 370(*a*) and 370(*b*) as set forth above stabilizes the coupling assemblies 25(*a*) and 25(*b*) and reduces the moment which can be created on the coupling assemblies 25(*a*) and 25(*b*) when a carrier 24 is connected to the miner 12 via the coupling assemblies 25(*a*) and 25(*b*) and when subsequent carriers 24 are connected to each other via the coupling assemblies 25(*a*) and 25(*b*). Further, the connector of the axles 374(*a*) and 374(*b*) of the female couplers 137(*a*) and 137(*b*) tends to reduce stress at the point of connection between the miner 12 and a carrier 24 and at the point of connection between carriers 24.

A framework 376 is disposed between the first and second beam 200 and 210 of the miner 12, generally near the rearward ends 204 and 214 of the first and second beams 200 and 210 and forward of the female couplers 137(*a*) and 137(*b*) of the coupling assemblies 25(*a*) and 25(*b*) and wheels 374(*a*) and 374(*b*) so that the framework 376 does not interfer with the coupling of a carrier 24 to the miner 12 via coupling assemblies 25(*a*) and 25(*b*) or with the rotational movement of the wheels 374(*a*) and 374(*b*). One end of the framework 376 is connected to the first beam 200 and the opposite end of the framework 376 is connected to the second beam 210. The framework 376 structurally supports the rearward end portions of the first and the second beams 200 and 210 in the spaced-apart relationship.

Figure 8:
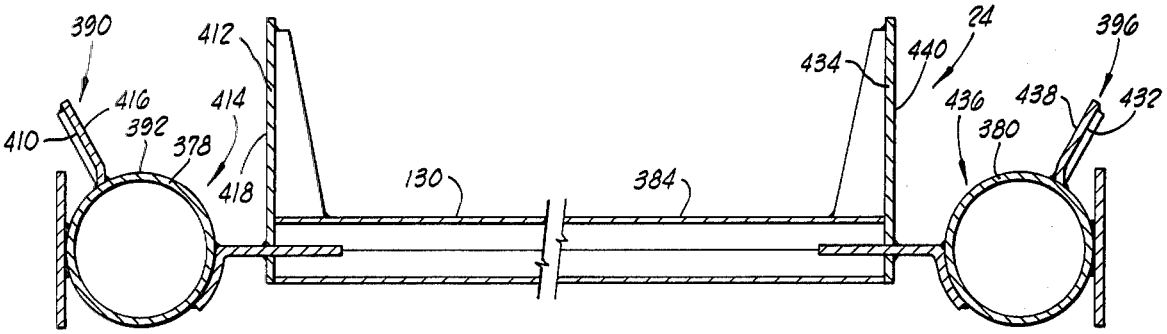
FIG. 8 is a sectional view of the carrier of FIGS. 6 and 7, taken substantially along line 8—8 of FIG. 7.

As shown more clearly in FIGS. 6, 7 and 8, the carriers 24 are each constructed in a similar manner and each carrier comprises the carrier frame 130, the male couplers 135(*a*) and 135(*b*), and the female couplers 137(*a*) and 137(*b*). Each carrier 24 also includes a first carrier beam 378 and a second carrier beam 380 (only one typical carrier 24 being shown in detail in FIGS. 6, 7 and 8 for clarity). The forward ends of the carrier beams 378 and 380 form the forward end 132 of the carrier 24 and the rearward ends of the carrier beams 378 and 380 form the rearward end 134 of the carrier 24.

The male coupler 135(*a*) is secured to the forward end of the first carrier beam 378 so that a connector end 382(*a*) of the male coupler 135(*a*) extends outwardly from the forward end of the first carrier beam 378 and the central longitudinal axis of the first carrier beam 378 substantially is aligned with the central longitudinal axis of the male coupler 135(*a*). The male coupler 135(*b*) is secured to the forward end of the second carrier beam 380 so that the connector end 382(*b*) of the male coupler 135(*b*) extends outwardly from the foward end of the second carrier beam 380 and the central longitudinal axis of the carrier beam 380 substantially is aligned with the central longitudinal axis of the male coupler 135(*b*).

The female coupler 137(*a*) is secured to the rearward end of the first carrier beam 378, the female coupler 137(*a*) being disposed rearwardly from the rearward end of the first carrier beam 378, so that the substantially T-shaped slot 364(*a*) is positioned to receive the connector end 382 of the male coupler 135 of another carrier 24. The central longitudinal axis of the first carrier beam 378 substantially is aligned with the central longitudinal axis of the female coupler 137(*a*).

The female coupler 137(*b*) is secured to the rearward end of the second carrier beam 380, the female coupler 137(*b*) being disposed rearwardly from the rearward end of the second carrier beam 380 so that the substantially T-shaped slot 364(*b*) is positioned to receive the connector end 382 of the male coupler 135 of another carrier 24. The central longitudinal axis of the second carrier beam 380 substantially is aligned with the central longitudinal axis of the female coupler 137(*b*).

A carrier framework 384 is disposed between the first and second carrier beams 378 and 380, generally near their rearward ends and forward of the female couplers 137(*a*) and 137(*b*) and thus wheels 374(*a*) and 374(*b*), so that the framework 384 does not interfer with the coupling of the carrier 24 to another carrier 24 or with the rotational movement of the wheels 374(*a*) and 374(*b*). One end of the carrier framework 384 is connected to the first carrier beam 378 and the opposite end of the carrier framework 384 is connected to the second carrier beam 380. The carrier framework 384 structurally supports the rearward end portions of the first and second carrier beams 378 and 380 in a spaced-apart relationship.

A forward carrier support beam 386 is disposed between the first and second carrier beams 378 and 380, generally near their forward ends. One end of the forward carrier support beam 386 is connected to the first carrier beam 378 and the opposite end of the forward carrier support beam 386 is connected to the second carrier beam 380. The forward carrier support beam 386 structurally supports the forward end portions of the first and second carrier beams 378 and 380 and the forward carrier support beam 386 cooperates with the carrier framework 384 to maintain the first carrier beam 378 in a generally parallel, spaced relationship with the second carrier beam 380.

The first carrier beam 378 of each of the carriers 24 is provided with a first forward conduit support 288 mounted generally near the forward end of the first carrier beam 378 and a first rearward conduit support 390 mounted generally near the rearward end of the first carrier beam 378, the first forward conduit support 388 and the first rearward conduit support 390 being generally disposed on the upper side 392 of the first carrier beam 378 and aligned one with the other. The second carrier beam 380 of each of the carriers 24 is likewise provided with a second forward conduit support 394 mounted generally near the forward end of the second carrier beam 380 and a second rearward conduit support 396 mounted generally near the rearward end of the second carrier beam 380, the second forward conduit support 394 and the second rearward conduit support 396 being generally disposed on the upper side 398 of the second carrier beam 380 and aligned one with the other.

The first forward conduit support 388 includes a first flange 400 and a second flange 402. The first flange 400 is secured at one end thereof to the upper side 392 of the first carrier beam 378 so that the opposed other end of the first flange 400 projects in an upwardly and outwardly direction from the upper side 392 of the first carrier beam 378, as shown in FIG. 7. The second flange 402 is secured at one end to the forward carrier support beam 386 so that the opposed other end of the second flange 402 projects upwardly from the forward carrier beam 386. The first flange 400 and the second flange 402 substantially are aligned one with the other in a spaced-apart relationship so that the conduit 46 can be positioned and maintained within the space 404 formed by the interior side 406 of the first flange 400, the upper side 392 of the first carrier beam 378 and the exterior side 408 of the second flange 402.

The first rearward conduit support 390 includes a first flange 410 and a second flange 412. The first flange 410 is secured at one end to the upper side 392 of the first carrier beam 378 so that the opposed other end of the first flange 410 projects in an upwardly and outwardly direction from the upper side 392 of the first carrier beam 378, as shown in FIG. 8. The second flange 412 is secured at one end to the framework 384 so that the opposed other end of the second flange 412 projects upwardly from the framework 384, as shown in FIG. 7. The first flange 410 and the second flange 412 are substantially aligned one with another in a spaced-apart relationship so that conduit 46 can be positioned and maintained within the space 414 formed by the interior side 416 of the first flange 410, the upper side 392 of the first carrier beam 378 and the exterior side 418 of the second flange 412.

The second forward conduit support 394 includes a first flange 420 and a second flange 422. The first flange 420 is secured at one end to the upper side 398 of the second carrier beam 380 so that the opposed other end of the first flange 420 projects in an upwardly and outwardly direction from the upper side 398 of the second carrier beam 380, as shown in FIG. 7. The second flange 422 is secured at one end to the forward carrier support beam 386 so that the opposed other end of the second flange 422 projects upwardly from the forward carrier support beam 386. The first flange 420 and the second flange 422 are substantially aligned one with another in a spaced-apart relationship so that the conduit 361 can be positioned and maintained within the space 426 formed by the interior side 428 of the first flange 420, the upper side 398 of the second carrier beam 380 and the exterior side 430 of the second flange 422.

The second rearward conduit support 396 includes a first flange 432 and a second flange 434. The first flange 432 is secured at one end to the upper side 398 of the second carrier beam 380 so that the opposed other end of the first flange 432 projects in an upwardly and outwardly direction from the upper side 398 of the second carrier beam 380, as shown in FIG. 8. The second flange 434 is secured at one end of the carrier framework 384 so that the opposed other end of the second flange 434 projects upwardly from the carrier framework 384. The first flange 432 and the second flange 434 are substantially aligned one with another in a spaced-apart relationship so that conduit 361 can be positioned in and maintained in the space 436 formed by the interior side 438 of the first flange 432, the upper side 398 of the second carrier beam 380 and the exterior side 440 of the second flange 434.

The first and second carrier beams 378 and 380 are desirably constructed to include enclosed, fluid-tight, void compartments or spaces, the enclosed compartments not being shown in the drawings. The void compartments (filled with air or the like) produce a buoyant effect which acts to effectively reduce the weight of the first and second carrier beams 378 and 380 when emersed in the drilling fluid, thereby effectively reducing the normal forces and the frictional forces associated with the carriers 24 during the operation of the miner 12. The construction of the carriers 24 in the manner just described, in combination with the coupling assembly 25, enables the miner 12 to be utilized for borning holes having greater lengths as compared to a mining apparatus having carriers which do not include the enclosed, void, fluid-tight compartments.

The conduits 46 and 361 are desirably constructed of a flexible material and the flexible conduits 46 and 361 are fed into the borehole 88 along with the driving of the miner 12 and the carriers 24 into the borehole 88. The conduits 46 and 361 are positioned on the carriers 24 after the carrier 24 has been connected to the miner 12 or another carrier 24 through the coupling assemblies 25 by positioning the flexible conduit 46 in the spaces 404 and 414 formed in the first forward conduit support 388 and the first rearward conduit support 390 of the first carrier beam 378, respectively, as described before, and positioning the flexible conduit 361 in the spaces 426 and 436 formed in the second forward conduit support 394 and the second rearward conduit support 396, respectively, as described before.

The flexible conduits 46 and 361 are passed through a tension assembly 450 (an embodiment of a tension assembly 450 for conduit 46 being shown in FIG. 1, for example) which is interposed between a supply source of the flexible conduit 46 (not shown) and the connection of the flexible conduit 46 to the last connected carrier 24, the tension assembly 450 being constructed to maintain a predetermined tension on the portion of the conduit being positioned on the carriers 24 and to facilitate the feeding of the flexible conduit 46 into the borehole 88. As illustrated in FIG. 1, the tension assembly 450 also can be utilized to feed the flexible conduit 361 or, in the alternative, the tension assembly 450 can be utilized to feed the control lines 34, 56, 60, 68, 72, 98, 102 and 104 into the conduit 361 positioned on the carriers 24, as the miner 12 and the carriers 24 are moved into the borehole 88. The conduits 46 and 361 preferably include a plurality of interconnected conduits (not shown) with one of the interconnected conduits (not shown) being disposed on each carrier 24.

Figure 11:
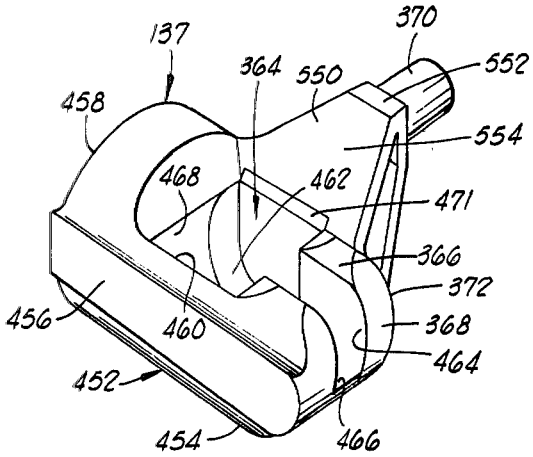
FIG. 11 is an enlarged perspective view of the female coupler of the coupling assembly of the invention.
Figure 12:
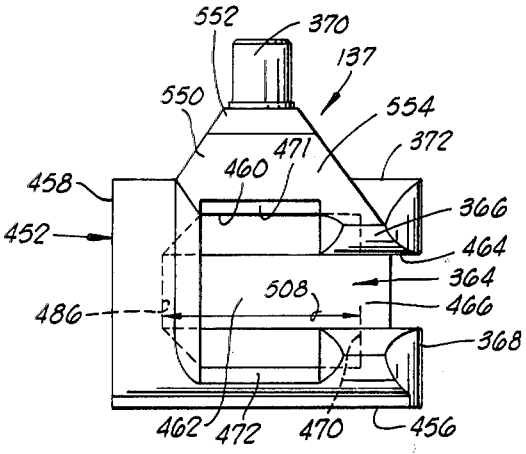
FIG. 12 is a plan view of the female coupler of FIG. 11.
Figure 13:
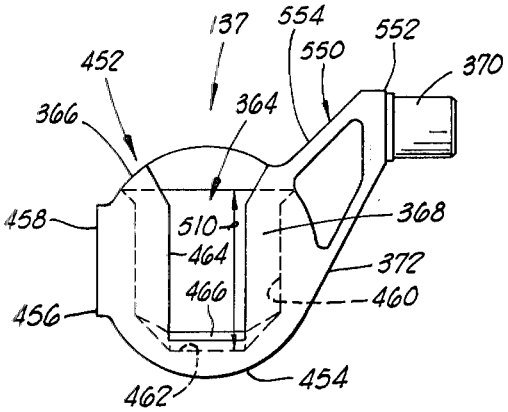
FIG. 13 is a front elevational view of the female coupler of FIG. 11.

The female couplers 137 are identical in construction and a typical female coupler 137 is shown in greater detail in FIGS. 11, 12 and 13. The female coupler includes a body member 452 having the upper side 366, a lower side 454, the first side 372, a second side 456, the rearward end 368 and a forward end 458.

A first slot 460 is formed in the body member 452, the first slot 460 extending through a central portion of the upper side 366 and extending a distance through the body member 452 terminating with a lower surface 462. The lower surface 462 is spaced a distance from the lower side 454 of the body member 452.

A second slot 464 is formed in the body member 452, the second slot 464 extending through the upper side 366 of the body member 452 and extending a distance through the body member 452 terminating with a lower surface 466. The lower surface 466 is spaced a distance from the lower side 454 of the body member 452 and, in a preferred form, the lower surface 466 substantially is co-planar with the lower surface 462 formed in the body member 452 by the first slot 460. The second slot 464 intersects the rearward end 368 of the body member 452 and intersects a central portion of the first slot 460, the second slot 464 providing communication between the rearward end 368 of the body member 452 and the first slot 460.

A forward recess 468 is formed in the body member 452, the forward recess 468 intersecting one of the walls formed in the body member 452 by the first slot 460 and extending a distance into the body member 452 generally toward the forward end 458. The forward recess 468 extends from near the lower surface 462 formed in the body member 452 by the first slot 460 a distance generally toward the upper side 366 of the body member 452, the forward recess 468 being spaced a distance from the upper side 366, as shown more clearly in FIG. 12.

A rearward recess 470 is formed in the body member 452, the rearward recess 470 extending through one of the walls formed in the body member 452 by the first slot 460 a distance generally toward the rearward end 368 of the body member 452. The rearward recess 470 is positioned in the body member 452 generally opposite the forward recess 468. The rearward recess 470 extends from near the lower surface 462 formed in the body member 452 by the first slot 460 a distance generally from the lower surface 462 toward the upper side 366 of the body member 452, the rearward recess 470 being spaced a distance from the upper side 366 of the body member 452. More particularly, a portion of the rearward recess 470 is disposed on one side of the second slot 464 and another portion of the rearward recess 470 is disposed on the opposite side of the slot 464.

The lower surfaces 462 and 466 formed by the first and the second slots 460 and 464, respectively, and the lower surfaces formed in the body member 452 by the forward and the rearward recesses 468 and 470 are each formed on a curve and positioned in the body member 452 to provide a continuous curved surface extending generally between the forward and the rearward ends 458 and 368 of the body member 452. As shown more clearly in FIG. 11, the curved surface formed by the lower surfaces 462 and 466 and the lower surfaces of the forward and the rearward recesses 368 and 470 extends a distance up the wall formed in the body member 452 by the forward recess 468, generally near the forward end 458, and the curved lower surface also extends a distance up the wall formed in the body member 452 by the rearward recess 470, generally near the rearward end 368.

The width of the first slot 460 generally between the first and the second sides 372 and 456 is greater than the width of the second slot 464 generally between the first and the second sides 372 and 456. The first and the second slots 460 and 464 and the forward and the rearward recesses 468 and 470 are shaped and positioned in the body member 452 to provide the substantially T-shaped slot 364, referred to before.

A portion of two of the walls formed in the body member 452 by the first slot 460, generally adjacent the upper side 366, are tapered outwardly, the tapered portions being designated by the reference numerals 471 and 472 in FIGS. 11, 12 and 13. The tapered portions 471 and 472 cooperate to facilitate the guiding of the connector end 382 of the male coupler 135 into the first slot 460.

Figure 14:
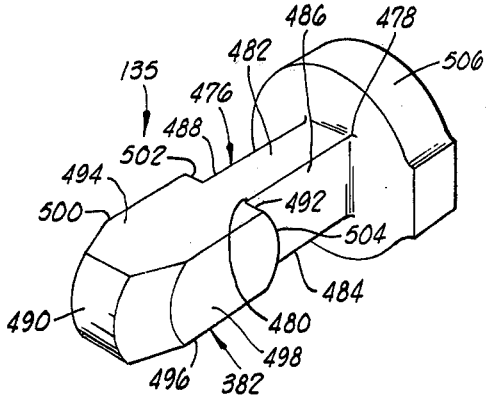
FIG. 14 is an enlarged perspective view of the male coupler of the coupling assembly of the invention.
Figure 15:
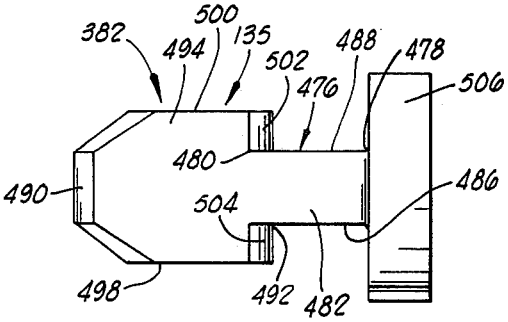
FIG. 15 is a plan view of the male coupler of FIG. 14.
Figure 16:
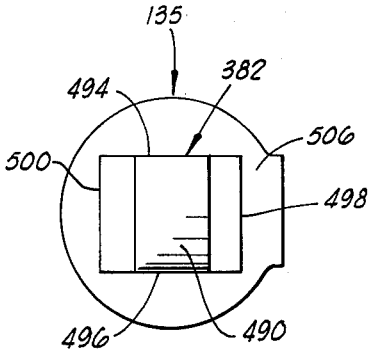
FIG. 16 is a front elevational view of the male coupler of FIG. 14.

The male couplers 135 are identical in construction and a typical male coupler 135 is shown in greater detail in FIGS. 14, 15 and 16. The male coupler 135 includes a stem 476 and the connector end 382.

The stem 476 has a first end 478, a second end 480, an upper side 482, a lower side 484, a first side 486 and a second side 488. The stem 476 has a generally rectangular shape and is shaped such that a portion of the stem 472 is movably insertable into the second slot 464 during the connecting of the male and female couplers 135 and 137.

The connector end 382 of the male coupler 135 includes a first end 490, second end 492, an upper side 494, a lower side 496, a first side 498 and a second side 500. The second end 492 of the connector end 382 is connected to the second end 480 of the stem 476 and the stem 476 is positioned on the connector end 382 such that a portion of the connector end 382 extends a distance from the second side 488 of the stem 476, thereby providing a first shoulder 502, and such that another portion of the connector end 382 extends a distance from the first side 486 of the stem 476, thereby providing a second shoulder 504.

The first shoulder 502 is formed on a curve extending generally between the upper side 494 and the lower side 496 of the connector end 382. The curvature of the first shoulder 502 generally corresponds to the curvature of the wall formed in the body member 452 by the rearward recess 470. The second shoulder 504 also is formed on a curve extending generally between the upper and the lower sides 494 and 496 of the connector end 382. The curvature of the second shoulder 504 generally corresponds to the curvature of the wall formed in the body member 452 by the rearward recess 470.

The upper side 482 of the stem 476 is generally coplaner with the upper side 494 of the connector end 382 and the lower side 484 of the stem 476 is generally coplaner with the lower side 496 of the connector end 382. The first end 490 of the connector end 382 is shaped on a curve extending generally between the upper and the lower sides 494 and 496 of the connector end 382. A portion of the first side 498 of the connector end 382, generally near the first end 490, is formed on a curve extending a distance generally from the first end 490 toward the second end 492, the curved portion tapering inwardly toward the first end 490. A portion of the second side 500 of the connector end 382 is formed on a curve extending the distance generally from the first end 490 toward the second end 492 of the connector end 382, the curved portion tapering inwardly toward the first end 490.

The curved surfaces formed on the first end 490 and the first and the second sides 498 and 500 of the connector end 382 are shaped to cooperate with the curved surfaces formed in the body member 452 to facilitate the connecting of the male and the female couplers 135 and 137.

The male coupler also has a base 504 which is connected to the first end 478 of the stem 476. The base 504 generally is cylindrically shaped and the stem 476 is connected to a central portion of one end of the base 504. The base 504 has a substantially circular configuration which corresponds to the substantially circular cross-sectional configuration of the first and second carrier beams 378 and 380 to facilitate the connecting of the male couplers 135 to the carrier beams 378 and 380.

In general, the first slot 460 of the body member 452 is shaped to receive and accommodate a portion of the connector end 382 in a connected position of the male and the female couplers 135 and 137, the forward and the rearward recesses 468 and 470 also cooperating with the first slot 460 to accommodate the connector end 382 in the connected position with the male and the female couplers 135 and 137. The second slot 464 in the body member 452 is shaped to receive and accommodate a portion of the stem 476 in a connected position of the male and female couplers 135 and 137.

To connect the male and the female couplers 135 and 137, the male coupler is positioned generally above the first slot 460 with the connector end 382 of the male coupler 135 generally facing the lower surface 462 in the body member 452. In this position, the connector end 382 of the male coupler 135 is moved into the first slot 460 in a direction generally from the upper side 366 toward the lower side 454 to a position wherein the first end 490 of the connector end 382 abuts the lower surface 462 in the body member 452, thereby positioning the male coupler 135 in an insert position with respect to the female coupler 137. After the male coupler has been positioned in the initial insert position within the first slot 460, the male coupler 135 is rotated about ninety degrees (90°) in a direction generally from the upper side 366 toward the lower side 454 of the body member 452. A portion of the stem 476 is inserted within the second slot 464 as the male coupler 135 is rotated from the insert position toward a connected position, the male coupler 135 being rotated to the connected position wherein a portion of the lower side 484 of the stem 476 abuts the lower surface 466 formed in the body member 452 by the second slot 464.

In the connected position of the male and female couplers 135 and 137, a portion of the stem 476 is disposed within the second slot 464 with the lower side 484 of the stem 476 being disposed near the lower surface 466 formed in the body member 452 by the second slot 464 and the connector end 382 is disposed within the opening formed in the body member 452 by the first slot 460 and the forward and the rearward recesses 468 and 470 with the first end 490 of the connector end 382 being disposed near the wall formed in the body member 452 by the forward recess 468. Further, in the connected position of the male and female couplers 135 and 137, a portion of the connector end 382 generally near the first shoulder 502 is disposed within a portion of the space formed in the body member 452 by the rearward recess 470 on one side of the second slot 464 and a portion of the connector end 382 generally near the second shoulder 504 is disposed within the opening formed in the body member 452 by the rearward recess 472 generally on the opposite side of the second slot 464.

The length of the connector end 382 generally between the first end 490 and the second end 492 is less than a length 508 extending between the walls formed in the body member 452 by the forward and the rearward recesses 468 and 470 to permit movement of the connector end 382 in the space formed in the body member 452 by the first slot 460 and the forward and the rearward recesses 468 and 470 in directions generally between the forward end 458 and the rearward end 368 of the body member 452. Further, the width of the connector end 382 generally between the upper and the lower sides 494 and 496 is less than a width 510 formed in the body member 452 by the forward recess 468 and extending generally between the upper and the lower sides 366 and 454 of the body member 452 to permit the movement of the connector end 382 from the insert position to the connected position.

In the connected position of the male and female couplers 135 and 137, the connector end 382 is permitted to move within the opening formed in the body member 452 by the first slot 406 and the forward and the rearward recesses 468 and 470 between one position wherein the first end 490 of the connector end 382 abuts the wall formed in the body member by the forward recess 468 to another position wherein the first shoulder 502 of the connector end 382 abuts the wall formed in the body member 452 by a portion of the rearward recess 470 on one side of the second slot 464 and the second shoulder 504 of the connector end 382 abuts the wall formed in the body member 452 by the second slot 464 on the opposite side of the second slot 464.

To move the coupling assembly 25 from the connected position to the disconnected position, the male coupler 135 is moved to a disconnected position wherein the first end 490 abuts the wall formed on the body member 452 by the forward recess 468. Then, the male coupler 135 is rotated about ninety (90°) in a direction generally from the lower side 454 toward the upper side 366 of the body member 452 to a position wherein the first end 490 of the connector end 382 abuts the lower surface 462 formed in the body member 452 by the first slot 460, the stem 476 extending out of the first slot 460 and generally away from the upper side 366 of the body member 452 in this position. In other words, to disconnect the male and the female couplers 135 and 137, the male coupler 135 first is moved to the disconnect position and then to the insert position with respect to the female coupler 137. In this position of the male coupler 135, the male coupler 135 is moved in a direction generally away from the body member 452, thereby withdrawing the connector end from the first slot 460 in the body member 452.

The female coupler 137 of the coupling assembly 25 further includes an axle support bracket 550, having one end secured to the first side 372 of the body member 452. The axle support bracket 550 extends upwardly from the upper side 366 of the body member 452 and outwardly from the first side 372 of the body member 452, so as to not interfere with the coupling of the male and the female couplers 135 and 137. One end of the axle 370 is secured to an upwardly, outwardly extending end 552 of the axle support bracket 550 so that the axle 370 extends horizontally away from the axle support bracket 550 and from the second side 506 of the body member 452.

The axle support bracket 550 provides an angularly extending fuide surface 554, which is positioned and oriented to engage the connecting end 382 of the male coupler 135 and to guide the connecting end 382 into the first slot 364 of the female coupler 137 during the connecting of the male and the female couplers 135 and 137. As described before, two female couplers 137 are connected to the rearward end 134 of each carrier frame 130 and, in this instance, the guide surfaces 554 of the two female couplers 137 extend upwardly and outwardly in opposite directions, the two surfaces 554 cooperating to engage the connecting ends 382 of the male couplers 135 and to guide the connecting ends 382 into the first slot 364 of the respective female couplers 137.

As previously stated, one male coupler 135 is secured to the forward end of each carrier beam 378 and 380 of each carrier 24. Such can be accomplished by abutting the base 504 of one male coupler 135 to the forward end of each carrier beam 378 and 380 and thereafter securing the base 504 to the forward end of the carrier beam by any suitable means, such as welding. One female coupler 137 is secured to the rearward end of each carrier beam 378 and 380 of each carrier 24, and to the rearward end of the miner 12 by abutting the forward end 458 to the rearward end of the miner 12, the body member 452 being secured to the miner 12 by any suitable means, such as welding. The securing of the male coupler 135 to the forward end of each of the carrier beams 378 and 380 and the female coupler 137 to the rearward end of each of the carrier beams 378 and 380 sealingly encloses the carrier beams 378 and 380 and creates a void compartment within the carrier beams 378 and 380 for imparting the desired buoyancy to the carrier beams 378 and 380, as mentioned before.

In a modified embodiment (not shown in the drawings), the end 390 of the male coupler 135 and a portion of the sides 498 and 500, generally adjacent the end 390, are rounded on a radius and the shoulders 502 and 504 are rounded substantially on the same radius. Further, the walls formed in the body member 452 of the female coupler 137 by the rearward recess 470 are rounded substantially on the same radius as the radius of curvature of the shoulders 502 and 504 of the male coupler 135, and the wall formed in the body member 452 by the forward recess 468 is rounded substantially on the same radius as the radius of curvature of end 390 and the portion of the sides 498 and 500. The width of the stem 476, generally between the sides 486 and 488, is less than the width of the second slot 464 to permit limited rotational movement of the male coupler 135 in the first and second slots 460 and 464 generally between the first and the second sides 372 and 456 in a connected position of the male and the female couplers 135 and 137.

It should be noted that the coupling assembly could be utilized to connect any two members. Further, numerous changes may be made in the various components, assemblies, and methods disclosed herein without departing from the spirit and the scope of the invention as defined in the claims.

What is claimed is:

1. A mining apparatus for forming a borehole in an earth formation comprising:

a miner, comprising:

a frame, having a forward end and a rearward end; and a forward cutter assembly connected to the forward end of the frame for excavatingly engaging the earth formation;

at least one carrier, each carrier having a forward end and a rearward end, the forward end of one of the carriers being removably connectable to the miner and the rearward end of the carrier being removably connectable to the forward end of one other carrier, each carrier comprising:

a carrier frame, having a forward end, a rearward end, a first side and a second side, comprising:

a first barrier beam having a forward end and a rearward end;

a second carrier beam having a forward end and a rearward end, the second carrier beam being spaced in a substantially parallel relationship with the first carrier beam, and the forward ends of the first and second carrier beams forming the forward end of the carrier frame and the rearward ends of the first and second carrier beams forming the rearward end of the carrier frame; and means for supporting the first and second carrier beams in the substantially parallel, spaced apart relationship;

coupling means comprising:

a first male coupler secured to the forward end of the first carrier beam;

a second male coupler secured to the forward end of the second carrier beam, the first and second male couplers being secured in a substantially parallel spaced relationship on one end of each of the carrier frames;

a first female coupler secured to the rearward end of the first carrier beam;

a second female coupler secured to the rearward end of the second carrier beam, the first and second female couplers being secured in a substantially parallel relationship on one end of each of the carrier frames, opposite the end with the male couplers, the first and second female couplers on one carrier frame being substantially alignable with the first and second male couplers on another carrier frame so that the first and second female couplers on one carrier frame operatively engage the first and second male couplers of another carrier frame to connect the respective ends of the two carrier frames;

a first female coupler and a second female coupler, the first and second female couplers being secured to the rearward end of the frame in a substantially parallel, spaced-apart relationship, the first and second female couplers on the miner being substantially alignable with the first and second male couplers on one end of one of the carrier frames so that the first and second female couplers of the miner operatively engage the first and second male couplers of the carrier frame to connect the miner to the carrier frame; and means connected to each carrier for movingly supporting each carrier, comprising:

a first axle secured at one end thereof to the first female coupler connected to the first carrier beam;

a second axle secured at one end thereof to the second female coupler connected to the second carrier beam;

a first wheel mounted on the first axle; and a second wheel mounted on the second axle.

2. The mining apparatus of claim 1 wherein the first and second axles are an integral part of the first and second female couplers, respectively, and are positioned to extend from the first and second female couplers in a direction toward one another along a substantially common central axis.

3. The mining apparatus of claim 1 wherein said means for supporting the first and second carrier beams in a substantially parallel, spaced apart relationship comprises a carrier support framework having a first end and an opposed second end, the first end of the carrier support framework being secured to the first carrier beam and the opposed second end of the carrier support framework being secured to the second carrier beam, the carrier framework being secured to the first and second carrier beams near their rearward ends and forward of the first and second female couplers and forward of the first and second wheels to prevent interference between the first and second wheels and the first framework; and a forward carrier support beam having a first end and an opposed second end, the first end of the forward carrier support beam being secured to the first carrier beam and the opposed second end of the forward carrier support beam being secured to the second carrier beam, the forward carrier being secured to said first and second carrier beams near their forward ends and rearward of the first and second male couplers.

4. The mining apparatus of claim 1 defined further to include:

conduit support means mounted on each of the first and second carrier beams.

5. The mining apparatus of claim 4 wherein the conduit support means comprises:

a first forward conduit support bracket secured to the first carrier beam near the forward end of the first carrier beam;

a first rearward conduit support bracket secured to the first carrier beam near the rearward end of the first carrier beam, the first forward conduit support bracket and the first rearward conduit support bracket each having an open channel formed therein, the open channels being aligned along the longitudinal axis of the first carrier beam and shaped for receiving and supporting a conduit therein;

a second forward conduit support bracket secured to the second carrier beam near the forward end of the second carrier beam; and a second rearward conduit support bracket secured to the second carrier beam near the rearward end of said second carrier beam, the second forward conduit support bracket and the second rearward conduit support bracket each having an open channel formed therein the open channels being aligned along the longitudinal axis of the second carrier beam and shaped for receiving and supporting a conduit therein.

6. The mining apparatus of claim 1 wherein each male coupler comprises:

a stem having a first end, a second end, an upper side, a lower side, a first side and a second side; and a connector end having a first end, a second end, an upper side, a lower side, a first side and a second side, the second end of the connector end being connected to the second end of the stem and the connector end being shaped and positioned on the stem to provide a shoulder; and wherein each of the female couplers comprises:

a body member having an upper side, a lower side, a first side, a second side, a rearward end and a forward end, a first slot being formed in the body member through the upper side and extending a distance through the body member terminating with a lower surface spaced a distance from the lower side of the body member, a second slot being formed in the body member through the upper side and extending a distance through the body member terminating with a lower surface spaced a distance from the lower side of the body member, the second slot intersecting the first slot and the rearward end of the body member, the first slot being shaped to receive and accommodate the connector end and the second slot being shaped to receive and accommodate a portion of the stem in a connected position of the male coupler and the female coupler, the shoulder on the male coupler being engageable with a portion of the body member formed by the first slot to cooperate in maintaining the male coupler and the female coupler in the connected position.

7. The mining apparatus of claim 6 wherein the first slot and the second slot are each defined further as being shaped and positioned so the connector end of the male coupler is insertable into the first slot in the female coupler in an insert position of the male coupler and so the male coupler is movable from the insert position to a connected position moving the stem of the male coupler into the second slot and moving the coupling means into a connected position.

8. The mining apparatus of claim 7 wherein the male coupler is movable about ninety degrees (90°) from the insert position to the connected position.

9. The mining apparatus of claim 7 wherein the body member of the female coupler is defined further to include a forward recess in one of the walls formed in the body member by the first slot, generally opposite the wall intersected by the second slot, the forward recess extending a distance into the body member generally toward the forward end of the body member and extending from near the lower surface formed in the body member by the first slot a distance generally toward the upper side of the body member, the forward recess being spaced a distance from the upper side of the body member, the connector end of the male coupler being insertable into the first slot to an insert position wherein the first end portion of the connector end is disposed generally near the lower surface in the body member and a portion of the connector end generally near the first end thereof being disposable in the forward recess in the connected position.

10. The mining apparatus of claim 9 wherein the body member of the female coupler is defined further to include a rearward recess in one of the walls formed in the body member by the first slot generally opposite the forward recess, the rearward extending a distance into the body member generally toward the rearward end of the body member and extending from near the lower surface formed in the body member by the first slot a distance generally toward the upper side of the body member, the rearward recess being spaced a distance from the upper side of the body member, a portion of the connector end generally near the second end thereof being disposable in the rearward recess in the connected position.

11. The mining apparatus of claim 10 wherein the forward and the rearward recesses are shaped and positioned and the connector end is shaped to permit movement of the connector end in the space formed by the slot and the forward and rearward recesses in directions generally between the forward end and the rearward end of the body member.

12. The mining apparatus of claim 11 wherein the connector end and the forward recess are each sized and shaped to permit movement of the connector end toward the forward end of the body member to a disconnect position wherein the first end portion of the connector end is disposed near the wall formed in the body member by the forward recess, the male coupler being movable in the disconnect position to remove the stem from the second slot to permit the male coupler to be disconnected from the female coupler.

13. The mining apparatus of claim 10 wherein a portion of the rearward recess is disposed on one side of the second slot in the body member and another portion of the forward recess is disposed on the opposite side of the second slot; and wherein the connector end is defined further as being positioned on the stem to provide one shoulder extending from the first side of the stem and another shoulder extending from the second side of the stem, a portion of the connector end generally near one shoulder being disposable in the portion of the rearward recess disposed on one side of the second slot and a portion of the connector end generally near the other shoulder being disposable in the portion of the rearward recess disposed on the opposite side of the second slot in a connected position, the shoulders being engageable with portions of the body member to cooperate in retaining the male coupler and the female coupler in the connection position.

14. The mining apparatus of claim 9 wherein the first end of the connector is rounded and a portion of the second side of the connector end generally near the first end is rounded and a portion of the first side of the connector end generally near the first end is rounded to facilitate the moving of the male coupler into a connected position with respect to the female coupler.

15. The mining apparatus of claim 14 wherein the lower surface formed in the body member by the first slot is shaped on a curve to cooperate with the connector end of the male coupler for moving the male coupler from the insert position to the connected position.

16. The mining apparatus of claim 15 wherein the shoulder on the connector end is rounded to facilitate the connecting and disconnecting of the male and the female couplers.

17. The mining apparatus of claim 1 wherein the first and the second axles are positioned on the first and the second female couplers, respectively, to reduce the moment between interconnected carriers at the point of coupling between two interconnected carriers.

18. The mining apparatus of claim 1 wherein the first and the second axles are positioned on the first and the second female couplers, respectively, to reduce the stress at the point of coupling between two interconnected carriers.

19. A mining apparatus for forming a borehole in an earth formation comprising:

a miner, comprising:

a frame, having a forward end and a rearward end; and a forward cutter assembly connected to the forward end of the frame for excavatingly engaging the earth formation;

at least one carrier, each carrier having a forward end and a rearward end, the forward end of one of the carriers being removably connectable to the miner and the rearward end of the carrier being removably connectable to the forward end of one other carrier, each carrier comprising:

a carrier frame, having a forward end, a rearward end, a first side and a second side; and coupling means comprising:

at least one male coupler on one end of the carrier frame, each male coupler comprising:

a stem having a first end, a second end, an upper side, a lower side, a first side and a second side; and a connector end having a first end, a second end, an upper side, a lower side, a first side and a second side, the second end of the connector end being connected to the second end of the stem and the connector end being shaped and positioned on the stem to provide a shoulder, the upper side of the stem being substantially coplanar with the upper side of the connected end and the lower side of the stem being substantially coplanar with the lower side of the connector end;

at least one female coupler on the opposed end of said carrier frame, the female coupler on each carrier frame being adapted to receive the male coupler on one of the other second carrier frames to connect the carrier frames in an end to end relationship when the male coupler is operatively engaged with the female coupler, each female coupler comprising:

a body member having an upper side, a lower side, a first side, a second side, a rearward end and a forward end, a first slot being formed in the body member through the upper side and extending a distance through the body member terminating with a lower surface spaced a distance from the lower side of the body member, a second slot being formed in the body member through the upper side and extending a distance through the body member terminating with a lower surface spaced a distance from the lower side of the body member, the second slot intersecting the first slot and the rearward end of the body member, the first slot being shaped to receive and accommodate the connector end and the second slot being shaped to receiver and accoomodate a portion of the stem in a connected position of the male coupler and the female coupler, the shoulder on the male coupler being engagable with a portion of the body member formed by the first slot to cooperate in maintaining the male coupler and the female coupler in the connected position, the first slot and the second slot being shaped and positioned so the connector end of the male coupler is insertable into the first slot in the female coupler in an insert position of the male coupler and so the male coupler is movable from the insert position to a connected position moving the stem of the male coupler into the second slot and moving the coupling means into a connected position, the body member of the female coupler including a forward recess in one of the walls formed in the body member by the first slot, generally opposite the wall intersected by the second slot, the forward recess extending a distance into the body member generally toward the forward end of the body member and extending from near the lower surface formed in the body member by the first slot a distance generally toward the upper side of the body member, the forward recess being spaced a distance from the upper side of the body member, the connector end of the male coupler being insertable into the first slot to the insert position wherein the first end portion of the connector end is disposed generally near the lower surface in the body member and a portion of the connector end generally near the first end thereof being disposable in the forward recess in the connected position; and means connected to the carrier to movingly support the carrier.

20. The mining apparatus of claim 19 wherein the lower surface formed in the body member by the first slot is substantially coplanar with the lower surface formed in the body member by the second slot.

21. The mining apparatus of claim 19 wherein the second slot in the body member intersects the first slot at a midportion of the first slot.

22. The mining apparatus of claim 21 wherein the first slot has a width extending generally between the first and the second sides of the body member and the second slot has a width extending generally between the first and second sides of the body member, the width of the first slot being larger than the width of the second slot.

23. A mining apparatus for forming a borehole in an earth formation, comprising:

a miner, comprising:

a frame, having a forward end and a rearward end; and a forward cutter assembly connected to the forward end of the frame for excavatingly engaging the earth formation;

at least one carrier, each carrier having a forward end and a rearward end, the forward end of one of the carriers being removably connectable to the miner and the rearward end of the carrier being removably connectable to the forward end of one other carrier, each carrier comprising:

a carrier frame, having a forward end, a rearward end, a first side and a second side;

coupling means comprising:

a first male coupler and a second male coupler, the first and second male couplers being secured in a substantially parallel spaced relationship on one end of each of the carrier frames; and a first female coupler and a second female coupler, the first and second female couplers being secured in a substantially parallel relationship on one end of each of the carrier frames, opposite the end with the male couplers, the first and second female couplers on one carrier frame being substantially alignable with the first and second male couplers on another carrier frame so that the first and second female couplers on one carrier frame operatively engage the first and second male couplers of another carrier frame to connect the respective ends of the two carrier frames, the first and the second female couplers each comprising:

an axle support bracket having one end connected to the female coupler and extending a distance angularly therefrom to provide an angularly extending guide surface, the guide surface of the axle support bracket connected to the first female coupler being engageable with a male coupler for guiding the male coupler toward a connected position with the first female coupler and the axle support bracket connected to the second female coupler being engagable with a male coupler for guiding the male coupler toward a connected position with the second female coupler, the axle support bracket on the first female coupler being positioned with respect to the axle support bracket on the second female coupler so the guide surfaces on the axle support brackets cooperate in guiding the male couplers into connected positions with respect to the first and the second female couplers; and means connected to the carrier to movingly support the carrier.

24. A carrier having a forward end and a rearward end, the forward end of the carrier being removably connectable to a rearward end of a second carrier, and the rearward end of the carrier being removably connectable to a forward end of a third carrier, each of said carriers comprising:

a carrier frame, having a foward end, a rearward end, a first side and a second side;

coupling means comprising:

a first male coupler and a second male coupler, the first and second male couplers being secured in a substantially parallel spaced relationship on one end of the carrier frame;

a first female coupler and a second female coupler, the first and second female couplers being secured in a substantially parallel relationship on one end of the carrier frame opposite the end with the male couplers, the first and second female couplers on one carrier frame being substantially alignable with the first and second male couplers on another carrier frame so that the first and second female couplers on one carrier frame operatively engage the first and second male couplers of another carrier frame to connect the respective ends of the two carriers frames; and an axle support bracket having one end connected to the female coupler and extending a distance angularly therefrom to provide an angularly extending guide surface, the guide surface of the axle support bracket connected to the first female coupler being engagable with a male coupler for guiding the male coupler toward a connected position with the first female coupler and the axle support bracket connected to the second female coupler being engagable with a male coupler for guiding the male coupler toward a connected position with the second female coupler, the axle support bracket on the first female coupler being positioned with respect to the axle support bracket on the second female coupler so the guide surfaces on the axle support brackets cooperate in guiding the male couplers into connected positions with respect to the first and the second female couplers; and means connected to the carrier to movingly support the carrier movement through the earth formation.

25. The carrier of claim 24 wherein each carrier frame comprises:

a first carrier beam having a forward end and a rearward end;

a second carrier beam having a forward end and a rearward end, the second carrier beam being spaced in a substantially parallel relationship with the fist carrier beam, and the forward ends of the first and second carrier beams forming the forward end of the carrier frame and the rearward ends of the first and second carrier beams forming the rearward end of the carrier frame; and means for supporting the first and second carrier beams in the substantially parallel, spaced apart relationship.

26. The carrier of claim 25 wherein the first male coupler of the coupling means is secured to the forward end of the first carrier beam, the second male coupler of the coupling means is secured to the forward end of the second carrier beam, the first female coupler of the coupling means is secured to the rearward end of the first carrier beam and the second female coupler is secured to the rearward end of the second carrier beam.

27. The carrier of claim 26 wherein the means to movingly support the carrier is operatively connected to the first and second female couplers of the coupling assembly.

28. The carrier of claim 24 wherein each male coupler comprise:

a stem having a first end, a second end, an upper side, a lower side, a first side and a second side; and a connector end having a first end, a second end, an upper side, a lower side, a first side and a second side, the second end of the connector end being connected to the second end of the stem and the connector end being shaped and positioned on the stem to provide a shoulder; and wherein each of the female couplers comprises:

a body member having an upper side, a lower side, a first side, a second side, a rearward end and a forward end, a first slot being formed in the body member through the upper side and extending a distance through the body member terminating with a lower surface spaced a distance from the lower side of the body member, a second slot being formed in the body member through the upper side and extending a distance through the body member terminating with a lower surface spaced a distance from the lower side of the body member, the second slot intersecting the first slot and the rearward end of the body member, the first slot being shaped to receive and accommodate the connector end and the second slot being shaped to receive and accommodate a portion of the stem in a connected position of the male coupler and the female coupler, the shoulder on the male coupler being engageable with a portion of the body member formed by the first slot to cooperate in maintaining the male coupler and the female coupler in the connected position.

29. The carrier of claim 28 wherein the first slot and the second slot are each defined further as being shaped and positioned so the connector end of the male coupler is insertable into the first slot in the female coupler in an insert position of the male coupler and so the male coupler is movable from the insert position to a connected position moving the stem of the male coupler into the second slot and moving the coupling means into a connected position.

30. The carrier of claim 29 wherein the male coupler is movable about ninety degrees (90°) from the insert position to the connected position.

31. The carrier of claim 29 wherein the body member of the female coupler is defined further to include a forward recess in one of the walls formed in the body member by the first slot, generally opposite the wall intersected by the second slot, the forward recess extending a distance into the body member generally toward the forward end of the body member and extending from near the lower surface formed in the body member by the first slot a distance generally toward the upper side of the body member, the forward recess being spaced a distance from the upper side of the body member, the connector end of the male coupler being insertable into the first slot to an insert position wherein the first end portion of the connector end is disposed generally near the lower surface in the body member and a portion of the connector end generally near the first end thereof being disposable in the forward recess in the connected position.

32. The carrier of claim 31 wherein the body member of the female coupler is defined further to include a rearward recess in one of the walls formed in the body member by the first slot generally opposite the forward recess, the rearward recess extending a distance into the body member generally toward the rearward end of the body member and extending from near the lower surface formed in the body member by the first slot a distance generally toward the upper side of the body member, the rearward recess being spaced a distance from the upper side of the body member, a portion of the connector end generally near the second end thereof being disposable in the rearward recess in the connected position.

33. The carrier of claim 32 wherein the forward and the rearward recesses are shaped and positioned and the connector end is shaped to permit movement of the connector end in the space formed by the slot and the forward and rearward recesses in directions generally between the forward end and the rearward end of the body member.

34. The carrier of claim 33 wherein the connector end and the forward recess are each sized and shaped to permit movement of the connector end toward the forward end of the body member to a disconnect position wherein the first end portion of the connector end is disposed near the wall formed in the body member by the forward recess, the male coupler being movable in the disconnect position to remove the stem from the second slot to permit the male coupler to be disconnected from the female coupler.

35. The carrier of claim 32 wherein a portion of the rearward recess is disposed on one side of the second slot in the body member and another portion of the rearward recess is disposed on the opposite side of the second slot; and wherein the connector end is defined further as being positioned on the stem to provide one shoulder extending from the first side of the stem and another shoulder extending from the second side of the stem, a portion of the connector end generally near one shoulder being disposable in the portion of the rearward recess disposed on one side of the second slot and a portion of the connector end generally near the other shoulder being disposable in the portion of the rearward recess disposed on the opposite side of the second slot in a connected position, the shoulders being engageable with portions of the body member to cooperate in retaining the male coupler and the female coupler in the connected position.

36. The carrier of claim 31 wherein the first end of the connector is rounded and a portion of the second side of the connector end generally near the first end is rounded and a portion of the first side of the connector end generally near the first end is rounded to facilitate the moving of the male coupler into a connected position with respect to the female coupler.

37. The carrier of claim 36 wherein the lower surface formed in the body member by the first slot is shaped on a curve to cooperate with the connector end of the male coupler for moving the male coupler from the insert position to the connected position.

38. The carrier of claim 37 wherein the shoulder on the connector end is rounded to facilitate the connecting and disconnecting of the male and the female couplers.

39. The carrier of claim 28 wherein the lower surface formed in the body member by the first slot is substantially coplanar with the lower surface formed in the body member by the second slot.

40. The carrier of claim 28 wherein the second slot in the body member intersects the first slot at a midportion of the first slot.

41. The carrier of claim 40 wherein the first slot has a width extending generally between the first and the second sides of the body member and the second slot has a width extending generally between the first and second sides of the body member, the width of the first slot being larger than the width of the second slot.

42. A carrier having a forward end and a rearward end, the forward end of the carrier being removably connectable to a rearward end of the second carrier, and the rearward end of the carrier being removably connectable to a forward end of a third carrier, each of said carriers comprising:

a carrier frame, having a forward end, a rearward end, a first side and a second side, comprising:

a first carrier beam having a forward end and a rearward end;

a second carrier beam having a forward end and a rearward end, the second carrier beam being spaced in a substantially parallel relationship with the first carrier beam, and the forward ends of the first and second carrier beams forming the forward end of the carrier frame and the rearward ends of the first and second carrier beams forming the rearward end of the carrier frame; and means for supporting the first and second carrier beams in the substantially parallel, spaced apart relationship; and coupling means comprising:

a first male coupler and a second male coupler, the first and second male couplers being secured in a substantially parallel spaced relationship on one end of the carrier frame, the first male coupler being secured to the forward end of the first carrier beam and the second male coupler being secured to the forward end of the second carrier beam; and a first female coupler and a second female coupler, the first and second female couplers being secured in a substantially parallel relationship on one end of the carrier frame opposite the end with the male couplers, the first and second female couplers on one carrier frame being substantially alignable with the first and second male couplers on another carrier frame so that the first and second female couplers on one carrier frame operatively engage the first and second male couplers of another carrier frame to connect the respective ends of the two carrier frames, the first female coupler coupling means being secured to the rearward end of the first carrier beam and the second female coupler being secured to the rearward end of the second carrier beam; and means operatively connected to the first and second female couplers to movingly support the carrier movement through the earth formation, comprising:

a first axle secured at one end thereof to the first female coupler of the coupling means;

a second axle secured at one end thereof to the second female coupler of the coupling means;

a first wheel mounted on the first axle; and a second wheel mounted on the second axle.

43. The carrier of claim 42 wherein the first and second axles are an integral part of the first and second female couplers, respectively, and are positioned to extend from the first and second female couplers in a direction toward one another along a substantially common central axis.

44. The carrier of claim 42 wherein said means for supporting the first and second carrier beams in a substantially parallel, spaced apart relationship comprises:

a carrier support framework having a first end and an opposed second end, the first end of the carrier support framework being secured to the first carrier beam and the opposed second end of the carrier support framework being secured to the second support beam, the carrier framework being secured to the first and second carrier beams near their rearward ends but forward of the first and second female couplers and forward of the first and second wheels to prevent interference between the first and second wheels and the first framework; and a forward carrier support beam having a first end and an opposed second end, the first end of the forward carrier support beam being secured to the first carrier beam and the opposed second end of the forward carrier support beam being secured to the second carrier beam, the forward carrier being secured to the first and second carrier beams near their forward ends and rearward of the first and second male couplers.

45. The carrier of claim 42 which is defined further to include:

conduit support means mounted on each of the first and second carrier beams.

46. The carrier of claim 45 wherein said conduit support means comprises:

a first forward conduit support bracket secured to the first carrier beam near the forward end of the first carrier beam;

a first rearward conduit support bracket secured to the first carrier beam near the rearward end of the first carrier beam, the first forward conduit support bracket and the first rearward conduit support bracket each having an open channel formed therein, the open channel being aligned along the longitudinal axis of the first carrier beam and shaped for receiving and supporting a conduit therein;

a second forward conduit support bracket secured to the second carrier beam near the forward end of said second carrier beam; and a second rearward conduit support bracket secured to the second carrier beam near the rearward end of the second carrier beam, the second forward conduit support bracket and the second rearward conduit support bracket each having an open channel formed therein, the open channel being aligned along the longitudinal axis of the second carrier beam and shaped for receiving and supporting a conduit therein.

47. The carrier of claim 42 wherein the first and the second axles are positioned on the first and the second female couplers, respectively, to reduce the moment between interconnected carriers at the point of coupling between two interconnected carriers.

48. The carrier of claim 42 wherein the first and the second axles are positioned on the first and the second female couplers, respectively, to reduce the stress at the point of coupling between two interconnected carriers.

49. A carrier having a forward end and a rearward end, the forward end of the carrier being removably connectable to a rearward end of a second carrier, and the rearward end of the carrier being removably connectable to a forward end of a third carrier, each of said carriers comprising:

a carrier frame, having a forward end, a rearward end, a first side and a second side;

coupling means comprising:

at least one male coupler on one end of the carrier frame, each male coupler comprising:

a stem having a first end, a second end, an upper side, a lower side, a first side and a second side; and a connector end having a first end, a second end, an upper side, a lower side, a first side and a second side, the second end of the connector end being connected to the second end of the stem and the connector end being shaped and positioned on the stem to provide a shoulder, the upper side of the stem being substantially coplanar with the upper side of the connector end and the lower side of the stem being substantially coplanar with the lower side of the connector end; and at least one female coupler on the opposite end of the carrier frame, the female coupler being adapted to receive the male coupler of one of the other carrier frames to connect the carrier frames in an end-to-end relationshp when the male coupler of one carrier frame is operatively engaged with the female coupler of one of the other carrier frames, each female coupler comprising:

a body member having an upper side, a lower side, a first side, a second side, a rearward end and a forward end, a first slot being formed in the body member through the upper side and extending a distance through the body member terminating with a lower surface spaced a distance from the lower side of the body member, a second slot being formed in the body member through the upper side and extending a distance through the body member terminating with a lower surface spaced a distance from the lower side of the body member, the second slot intersecting the first slot and the rearwrd end of the body member, the first slot being shaped to receive and accommodate the connector end and the second slot being shaped to receive and accommodate a portion of the stem in a connected position of the male coupler and the female coupler, the shoulder on the male coupler being engageable with a portion of the body member formed by the first slot to cooperate in maintaining the male coupler and the female coupler in the connected position, the first slot and the second slot being shaped and positioned so the connector end of the male coupler is insertable into the first slot in the female coupler in an insert position of the male coupler and so the male coupler is movable from the insert position to a connected position moving the stem of the male coupler into the second slot and moving the coupling means into a connected position, the body member having a forward recess in one of the walls formed in the body member by the first slot, generally opposite the wall intersected by the second slot, the forward recess extending a distance into the body member generally toward the forward end of the body member and extending from near the lower surface formed in the body member by the first slot a distance generally toward the upper side of the body member, the forward recess being spaced a distance from the upper side of the body member, the connector end of the male coupler being insertable into the first slot to an insert position wherein the first end portion of the connector end is disposed generally near the lower surface in the body member and a portion of the connector end generally near the first end thereof being disposable in the forward recess in the connected position; and means connected to the carrier to movingly support the carrier movement through the earth formation.

50. A coupling assembly for connecting two members comprising:

a male coupler connected to one member comprising:

a stem having a first end, a second end, an upper side, a lower side, a first side and a second side; and a connector end having a first end, a second end, an upper side, a lower side, a first side and a second side, the second end of the connector end being connected to the second end of the stem and the connector end being shaped and positioned on the stem to provide a shoulder; and a female coupler connected to the other member comprising:

a body member having an upper side, a lower side, a first side, a second side, a rearward end and a forward end, a first slot being formed in the body member through the upper side and extending a distance through the body member terminating with a lower surface spaced a distance from the lower side of the body member, a second slot being formed in the body member through the upper side and extending a distance through the body member terminating with a lower surface spaced a distance from the lower side of the body member, the second slot intersecting the first slot and the rearward end of the body member, the first slot being shaped to receive and accommodate the connector end and the second slot being shaped to receive and accommodate a portion of the stem in a connected position of the male coupler and and the female coupler, the shoulder on the male coupler being engageable with a portion of the body member formed by the first slot to cooperate in maintaining the male coupler and the female coupler in the connected position, the first slot and the second slot being shaped and positioned so the connector end of the male coupler is insertable into the first slot in the female coupler in an insert position of the male coupler and so the male coupler is movable from the insert position to a connected position moving the stem of the male coupler into the second slot and moving the coupling means into a connected position, the body member of the female coupler including a forward recess in one of the walls formed in the body member by the first slot generally opposite the wall intersected by the second slot, the forward recess extending a distance into the body member generally toward the forward end of the body member and extending from near the lower surface formed in the body member by the first slot a distance generally toward the upper side of the body member, the forward recess being spaced a distance from the upper side of the body member, the connector end of the male coupler being insertable into the first slot to an insert position wherein the first end portion of the connector end is disposed generally near the lower surface in the body member and a portion of the connector end generally near the first end thereof being disposable in the forward recess in the connected position, and the upper side of the stem being substantially coplanar with the upper side of the connector end and the lower side of the stem being substantialy coplanar with the lower side of the connector end.

51. The coupling assembly of claim 50 wherein the male coupler is movable about ninety degrees (90°) from the insert position to the connected position.

52. The coupling assembly of claim 50 wherein the body member of the female coupler is defined further to include a rearward recess in one of the walls formed in the body member by the first slot generally opposite the rearward recess, the rearward recess extending a distance into the body member generally toward the rearward end of the body member and extending from near the lower surface formed in the body member by the first slot a distance generally toward the upper side of the body member, the rearward recess being spaced a distance from the upper side of the body member, a portion of the connector end generally near the second end thereof being disposable in the rearward recess in the connected position.

53. The coupling assembly of claim 52 wherein the forward and the rearward recesses are shaped and positioned and the connector end is shaped to permit movement of the connector end in the space formed by the slot and the forward and rearward recesses in directions generally between the forward end and the rearward end of the body member.

54. The coupling assembly of claim 53 wherein the connector end and the forward recess are each sized and shaped to permit movement of the connector end toward the forward end of the body member to a disconnect position wherein the first end portion of the connector end is disposed near the wall formed in the body member by the forward recess, the male coupler being movable in the disconnect position to remove the stem from the second slot to permit the male coupler to be disconnected from the female coupler.

55. The coupling assembly of claim 52 wherein the portion of the rearward recess is disposed on one side of the second slot in the body member and another portion of the rearward recess is disposed on the opposite side of the second slot; and wherein the connector end is defined further as being positioned on the stem to provide one shoulder extending from the first side of the stem and another shoulder extending from the second side of the stem, a portion of the connector end generally near one shoulder being disposable in the portion of the rearward recess disposed on the side of the second slot and a portion of the connector and generally near the other shoulder being disposable in the portion of the rearward recess disposed on the opposite side of the second slot in a connected position, the shoulders being engageble with portions of the body member to cooperate in retaining the male coupler and the female coupler in the connected position.

56. The coupling assembly of claim 50 wherein the first end of the connector is rounded and a portion of the second side of the connector end generally near the first end is rounded and a portion of the first side of the connector end generally near the first end is rounded to facilitate the moving of the male coupler into a connected position with respect to the female coupler.

57. The coupling assembly of claim 56 wherein the lower surface formed in the body member by the first slot is shaped on a curve to cooperate with the connector end of the male coupler for moving the male coupler from the insert position to the connected position.

58. The coupling assembly of claim 57 wherein the shoulder on the connector end is rounded to facilitate the connecting and disconnecting of the male and the female couplers.

59. The coupling assembly of claim 50 wherein the lower surface formed in the body member by the first slot is substantially coplanar with the lower surface formed in the body member by the second slot.

60. The coupling assembly of claim 50 wherein the second slot in the body member intersects the first slot at a midportion of the first slot.

61. The coupling assembly of claim 60 wherein the first slot has a width extending generally between the first and the second sides of the body member and the second slot has a width extending generally between the first and second sides of the body member, the width of the first slot being larger than the width of the second slot.

* * * * *